US006216302B1

(12) United States Patent
Preston et al.

(10) Patent No.: US 6,216,302 B1
(45) **Date of Patent: *Apr. 17, 2001**

(54) CARBON DIOXIDE DRY CLEANING SYSTEM

(75) Inventors: A. Duane Preston, New Prague; Jon R. Turner, Lakeville, both of MN (US)

(73) Assignee: MVE, Inc., New Prague, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/313,426

(22) Filed: May 17, 1999

Related U.S. Application Data

(63) Continuation-in-part of application No. 08/979,060, filed on Nov. 26, 1997, now Pat. No. 5,904,737.

(51) Int. Cl.[7] ..... D06F 43/08; B08B 3/10

(52) U.S. Cl. ..... 8/158; 8/142; 68/18 R; 68/18 C; 134/10; 134/12; 134/107

(58) Field of Search ..... 8/158, 142; 68/18 R, 68/18 C; 134/10, 12, 107

(56) References Cited

U.S. PATENT DOCUMENTS

| | | | | |
|---|---|---|---|---|
| 4,012,194 | * | 3/1977 | Chao et al. . | |
| 4,077,878 | * | 3/1978 | Jackson . | |
| 4,936,922 | * | 6/1990 | Cherry . | |
| 5,267,455 | * | 12/1993 | Dewees et al. . | |
| 5,279,615 | * | 1/1994 | Mitchell et al. . | |
| 5,344,493 | * | 9/1994 | Jackson . | |
| 5,412,958 | * | 5/1995 | Iliff et al. . | |
| 5,467,492 | * | 11/1995 | Chao et al. . | |
| 5,469,876 | | 11/1995 | Gray et al. . | |
| 5,486,212 | * | 1/1996 | Mitchell et al. . | |
| 5,538,025 | * | 7/1996 | Gray et al. | 134/107 X |
| 5,611,491 | * | 3/1997 | Bowers . | |
| 5,642,987 | * | 7/1997 | Taricco . | |
| 5,651,276 | * | 7/1997 | Purer et al. . | |
| 5,669,251 | * | 9/1997 | Townsend et al. . | |
| 5,822,818 | * | 10/1998 | Chao et al. | 68/18 R X |

FOREIGN PATENT DOCUMENTS

| | | |
|---|---|---|
| 0 828 020 A2 | 8/1997 | (EP) . |
| WO 94/01227 | 1/1994 | (WO) . |
| WO 96/15304 | 5/1996 | (WO) . |
| WO 97/33031 | 9/1997 | (WO) . |
| WO 99/13148 | 3/1999 | (WO) . |

* cited by examiner

*Primary Examiner*—Philip R. Coe
(74) *Attorney, Agent, or Firm*—Piper Marbury Rudnick & Wolfe

(57) ABSTRACT

A carbon dioxide dry cleaning system features a pair of liquid carbon dioxide storage tanks in communication with a compressor. A sealed cleaning chamber contains the objects being dry cleaned. By selectively pressurizing the storage tanks with the compressor, liquid carbon dioxide is made to flow to the cleaning chamber through cleaning nozzles so as to provide agitation of the objects being dry cleaned. Liquid carbon dioxide displaced from the cleaning chamber returns to the storage tanks. A still is disposed within one of the storage tanks and receives soiled liquid carbon dioxide as it is returned from the chamber. The pressure in the storage tank causes the soiled liquid carbon dioxide in the still to boil off. The gas is communicated to a third tank. The third tank may be used to initially pressurize the cleaning chamber. The system also includes a dispenser for the injecting solvent additives into the liquid carbon dioxide. The agitation pressure of the system may also be adjusted so that delicate objects may be cleaned without damage.

20 Claims, 18 Drawing Sheets

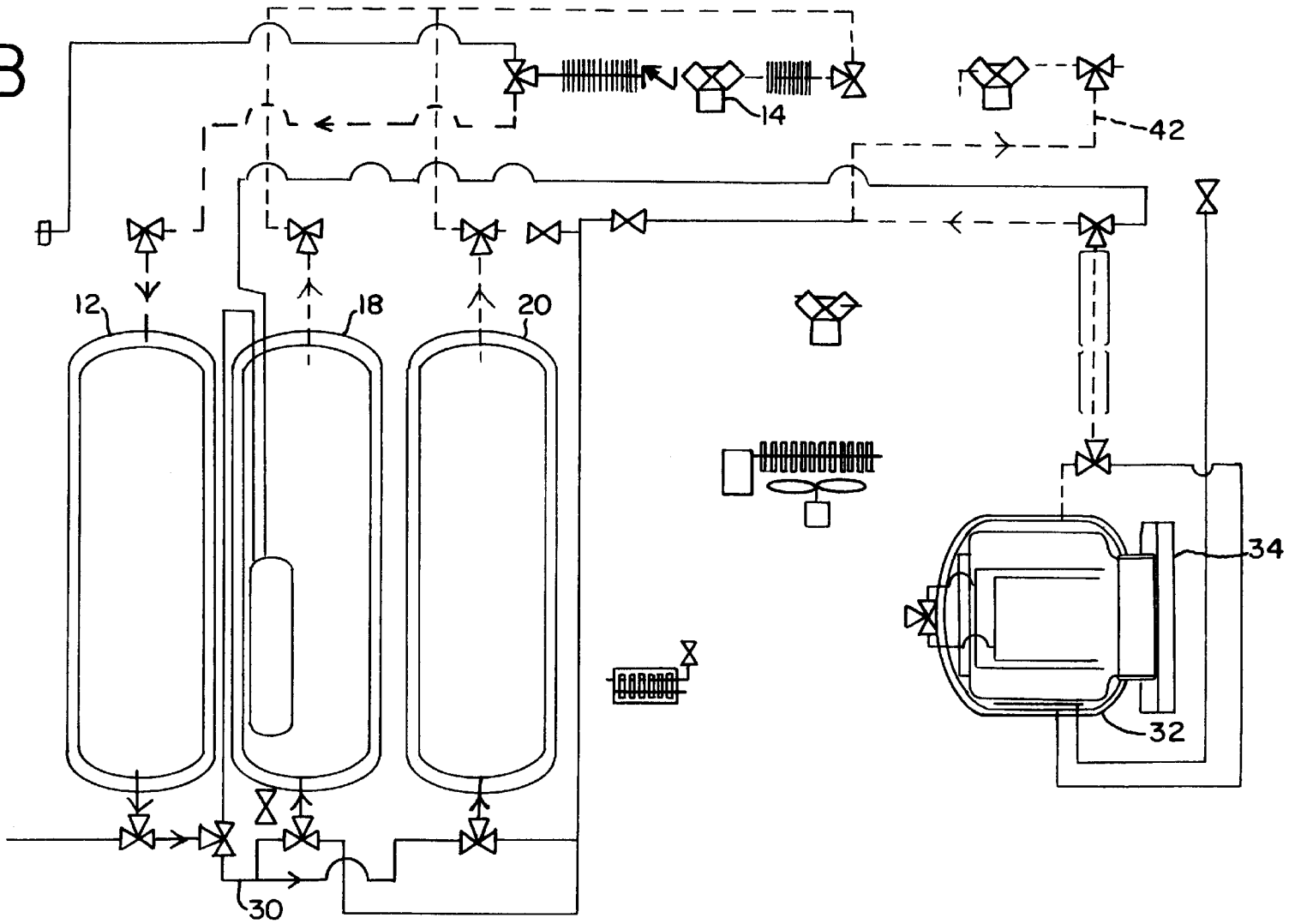
FIG. IB

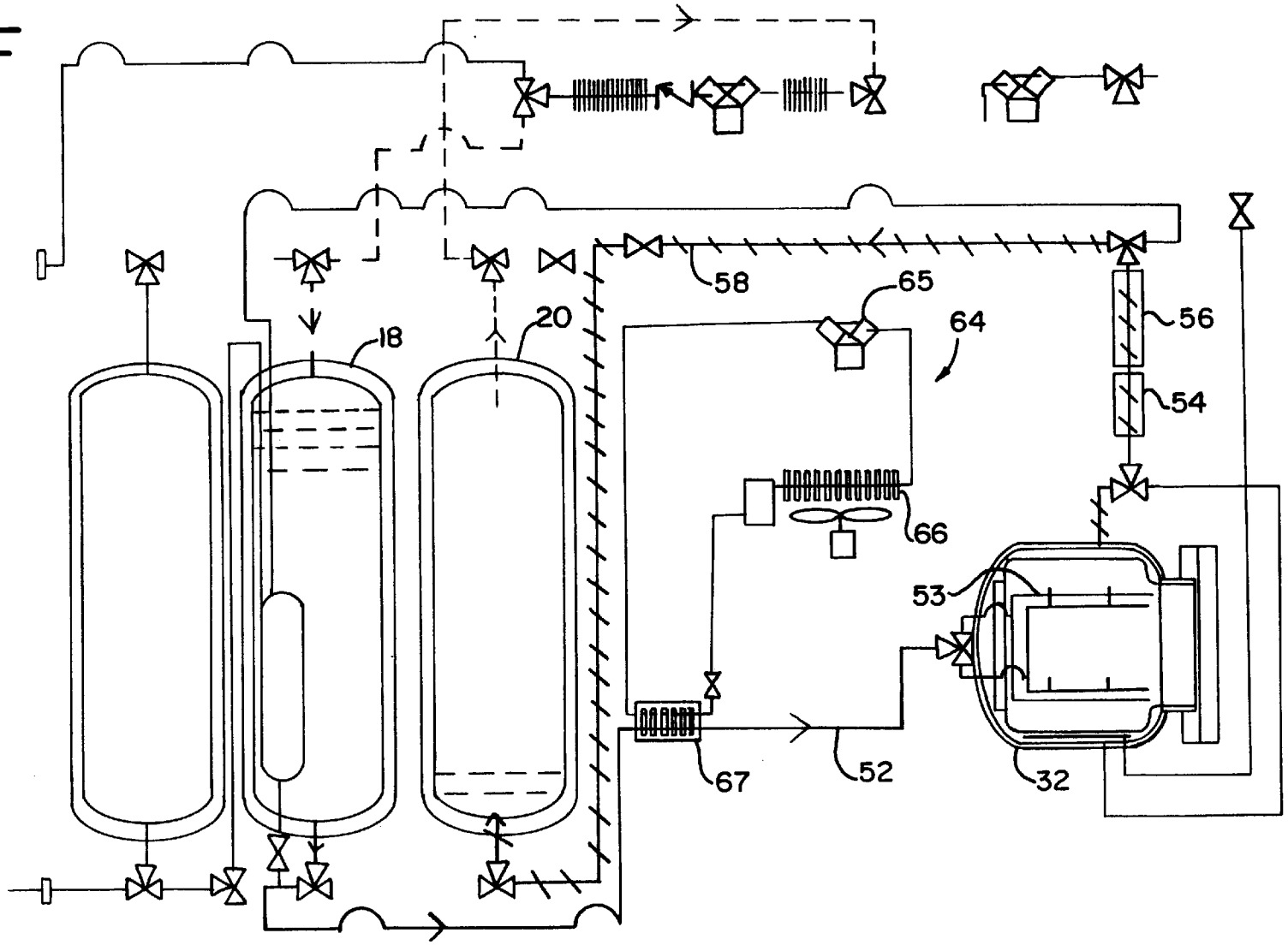
FIG. IF

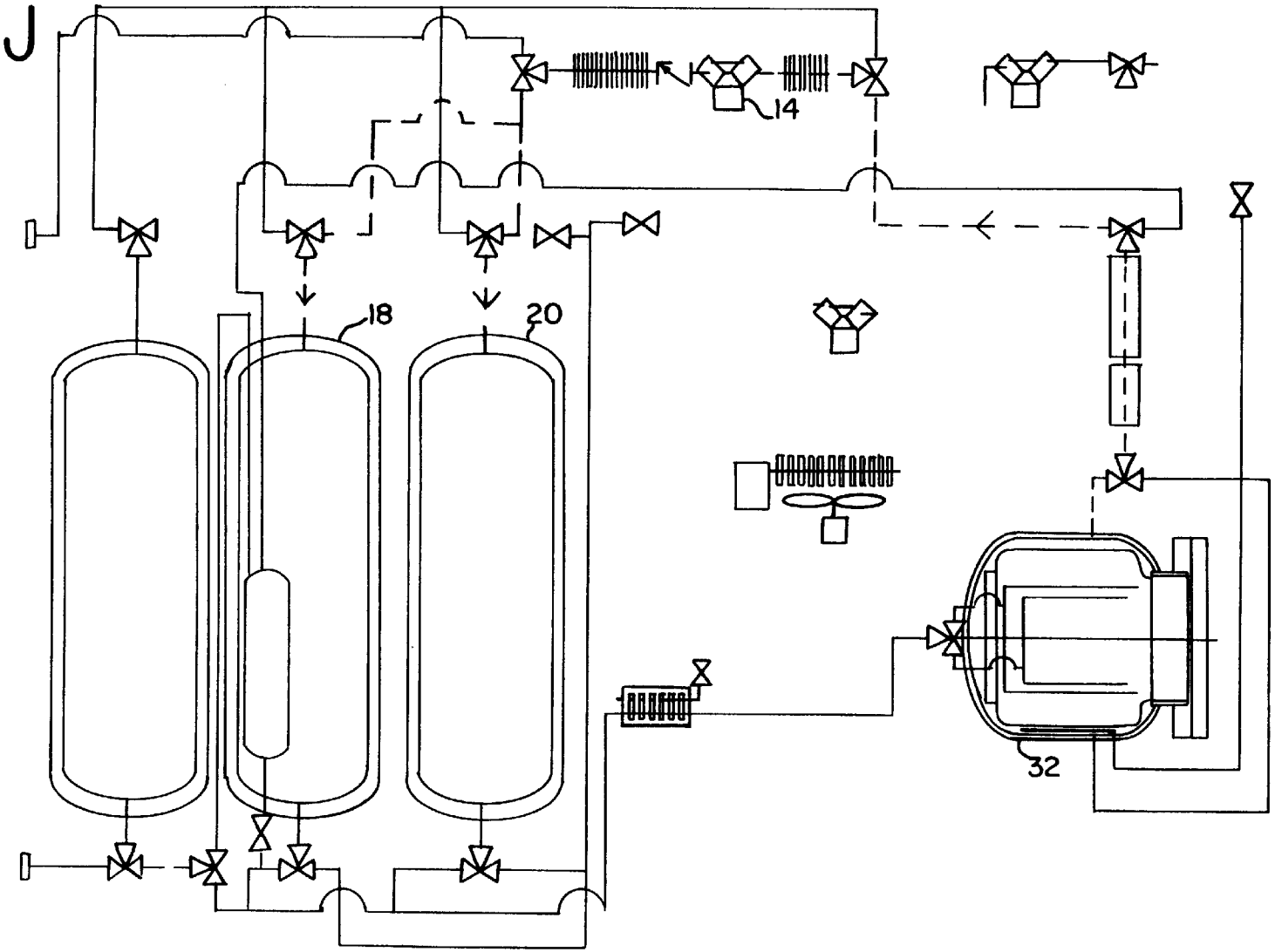
FIG.IJ

CARBON DIOXIDE DRY CLEANING SYSTEM

CROSS REFERENCE TO RELATED APPLICATIONS

This application is a continuation-in-part of U.S. application Ser. No. 08/979,060 filed Nov. 26, 1997, and now U.S. Pat. No. 5,904,737.

BACKGROUND

The present invention generally relates to carbon dioxide dry cleaning systems and, more particularly, to improved carbon dioxide dry cleaning systems that purify and reclaim carbon dioxide without the use of heaters and that do not use pumps to move liquid carbon dioxide.

The dry cleaning industry makes up one of the largest groups of chemical users that come into direct contact with the general public. Currently, the dry cleaning industry primarily uses perchloroethylene ("perc") and petroleum-based solvents. These solvents present health and safety risks and are detrimental to the environment. More specifically, perc is a suspected carcinogen while petroleum-based solvents are flammable and produce smog. For these reasons, the dry cleaning industry is engaged in an ongoing search for alternative, safe and environmentally "green" cleaning technologies, substitute solvents and methods to control exposure to dry cleaning chemicals.

Liquid carbon dioxide has been identified as a solvent that is an inexpensive and an unlimited natural resource. Furthermore, liquid carbon dioxide is non-toxic, non-flammable and does not produce smog. Liquid carbon dioxide does not damage fabrics or dissolve common dyes and exhibits solvating properties typical of more traditional solvents. Its properties make it a good dry cleaning medium for fabrics and garments. As a result, several dry cleaning systems utilizing carbon dioxide as a solvent have been developed.

U.S. Pat. No. 4,012,194 to Maffei discloses a simple dry cleaning process wherein garments are placed in a cylinder and liquid carbon dioxide is gravity fed thereto from a refrigerated storage tank. The liquid carbon dioxide passes through the garments, removing soil, and is transferred to an evaporator. The evaporator vaporizes the carbon dioxide so that the soil is left behind. The vaporized carbon dioxide is pumped to a condenser and the liquid carbon dioxide produced thereby is returned to the refrigerated storage tank.

The system of Maffei, however, does not disclose a means for agitating the garments. Furthermore, because the system of Maffei does not disclose a means for pressurizing the chamber, the carbon dioxide must be very cold to remain in a liquid state. Both of these limitations inhibit the cleaning performance of the Maffei system.

U.S. Pat. No. 5,267,455 to Dewees et al. discloses a system wherein liquid carbon dioxide is pumped to a pressurized cleaning chamber from a pressurized storage vessel. The cleaning chamber features a basket containing the soiled garments. The interior of the basket includes projecting vanes so that a tumbling motion is induced upon the garments when the basket is rotated by an electric motor. This causes the garments to drop and splash into the solvent. This method of agitation, known as the "drop and splash" technique, is used by the majority of traditional dry cleaning systems. After agitation, a compressed gas is pumped into the chamber to replace the liquid carbon dioxide. The displaced "dirty" liquid carbon dioxide is pumped to a vaporizer which is equipped with an internal heat exchanger. This allows "clean" gaseous carbon dioxide to be recovered and routed back to the storage vessel.

While the system of Dewees et al. overcomes the shortcomings of Maffei, namely, the lack of an agitation means and a pressurized cleaning chamber, it relies upon a pump to move its liquid carbon dioxide and utilizes a heat exchanger in its vaporizer. Both of these components add complexity, cost and maintenance requirements to the system. In addition, the mechanically rotating basket, whether achieved by large, magnetically coupled drives or by shafts, is expensive and has high maintenance costs.

Many patents have disclosed improved agitation arrangements for carbon dioxide dry cleaning systems. For example, U.S. Pat. No. 5,467,492 to Chao et al. discloses a fixed perforated basket combined with a variety of agitation techniques. These include "gas bubble/boiling agitation" where the liquid carbon dioxide in the basket is boiled, "liquid agitation" where nozzles spraying carbon dioxide tumble the liquid and garments, "sonic agitation" where sonic nozzles create agitating waves and "stirring agitation" where an impeller creates the fluid agitation. The remaining portion of the system of Chao, however, does not provide for a significant improvement over Dewees et al. in that a pump is still relied upon to move the liquid carbon dioxide from the system storage container to the cleaning chamber.

U.S. Pat. No. 5,651,276 to Purer et al. discloses an agitation technique which removes particulate soils from fabrics by gas jets. This gas agitation process is performed separately from the solvent-immersion process. Purer et al. further disclose that carbon dioxide may be employed both as the gas and the solvent. U.S. Pat. No. 5,669,251 to Townsend et al. discloses a rotating basket for a carbon dioxide dry cleaning system powered by a hydraulic flow emitted by a number of nozzles. This eliminates the need for rotating seals and drive shafts. While these two patents address agitation techniques, they do not address the remaining portion of the dry cleaning system.

Finally, the Hughes DRYWASH carbon dioxide dry cleaning machine, manufactured by Hughes Aircraft Company of Los Angeles, Calif., utilizes a pump to fill a pressurized cleaning chamber with liquid carbon dioxide. The cleaning chamber contains a fixed basket featuring four nozzles. As the basket is being filled with carbon dioxide, all four nozzles are open. Once the basket is filled, however, two of the nozzles are closed. The remaining two open nozzles are positioned so that they create an agitating vortex within the basket as liquid carbon dioxide flows through them. Soil-laden liquid carbon dioxide exits the basket and chamber and is routed to a lint trap and filter train. Furthermore, the system features a still that contains an electric heater so that soluble impurities may be removed.

While the Hughes DRYWASH system is effective, it also suffers the cost, maintenance and reliability disadvantages associated with a liquid pump and an electrically heated still.

Accordingly, it is an object of the present invention to provide a carbon dioxide dry cleaning system that utilizes both the solvent properties of carbon dioxide and high velocity liquid to remove insoluble particles.

It is a further object of the present invention to provide a carbon dioxide dry cleaning system that purifies and reclaims carbon dioxide without the use of an electrical heater or a heat exchanger.

It is still a further object of the present invention to provide a carbon dioxide dry cleaning system that moves liquid without the use of a pump.

It is still a further object of the present invention to provide an improved carbon dioxide handling system for use in a dry cleaning process.

It is still a further object of the present invention to provide an improved carbon dioxide dry cleaning system with adjustable agitation pressure so that delicate objects may be cleaned without damage.

It is still a further object of the present invention to provide an improved carbon dioxide dry cleaning system that may accommodate a solvent additive.

These and other objects of the invention will be apparent from the remaining portion of the Specification.

SUMMARY

The present invention is directed to a liquid carbon dioxide dry cleaning system that moves liquid carbon dioxide without the use of a pump and distills it without the use of an electric heater or a heat exchanger. Because liquid carbon dioxide, when used as a solvent, is at a high pressure and in a saturated state, suitable pumps are expensive and not nearly as reliable as devices used for ambient temperature liquids.

The preferred embodiment of the system features a pair of storage tanks containing liquid carbon dioxide. A compressor initially is connected in circuit between the head space of one of the storage tanks and a sealed cleaning chamber containing the objects being dry cleaned. The liquid side of the storage tank is connected to the cleaning chamber. As a result, the storage tank is pressurized so that liquid carbon dioxide flows from it to the cleaning chamber.

Next, the compressor is placed in circuit between the storage tanks so that gas may be withdrawn from the now empty storage tank and used to pressurize the other storage tank, also filled with liquid carbon dioxide. The liquid side of the empty storage tank remains connected to the cleaning chamber while the liquid side of the full storage tank is connected to cleaning nozzles within the cleaning chamber. As a result, when the full storage tank is pressurized, liquid carbon dioxide flows from it, through the nozzles and into the cleaning chamber so as to agitate the objects being cleaned. The displaced liquid carbon dioxide from the cleaning chamber flows back to the empty storage tank.

A still, submerged in the liquid carbon dioxide within one of the storage tanks, receives soiled liquid carbon dioxide from the cleaning chamber. Gas is withdrawn from the still by the compressor and is used to pressurize the storage tank containing the still. Alternatively, the still may be connected to the liquid side of a low pressure transfer tank. As a result, gas from the still is returned to the transfer tank where it is recondensed by the cold liquid carbon dioxide contained therein. In either case, the pressure difference created between the still and storage tank causes the soiled liquid carbon dioxide to boil due to the heat supplied by the liquid carbon dioxide surrounding the still. This removes the carbon dioxide in gaseous form leaving the contaminants in the still. Heat is also removed from the liquid carbon dioxide surrounding the still without reducing the heat in the system and without mechanical refrigeration.

Alternative embodiments of the present invention employ this distillation arrangement with a system that uses a cryogenic liquid pump to supply liquid carbon dioxide to the cleaning nozzles. An embodiment that places this pump within one of the liquid cryogen storage tanks is also disclosed.

The agitation pressure may be controlled so that delicate objects may be cleaned without damage. Solvent additives may also be injected into the liquid carbon dioxide.

For a more complete understanding of the nature and scope of the invention, reference may now be had to the following detailed description of embodiments thereof taken in conjunction with the appended claims and accompanying drawings.

BRIEF DESCRIPTION OF THE DRAWINGS

FIGS. 1A–1M are schematic diagrams illustrating the operation of a preferred embodiment of the carbon dioxide dry cleaning system of the present invention wherein three carbon dioxide tanks are used;

DESCRIPTION

Figure 1A:
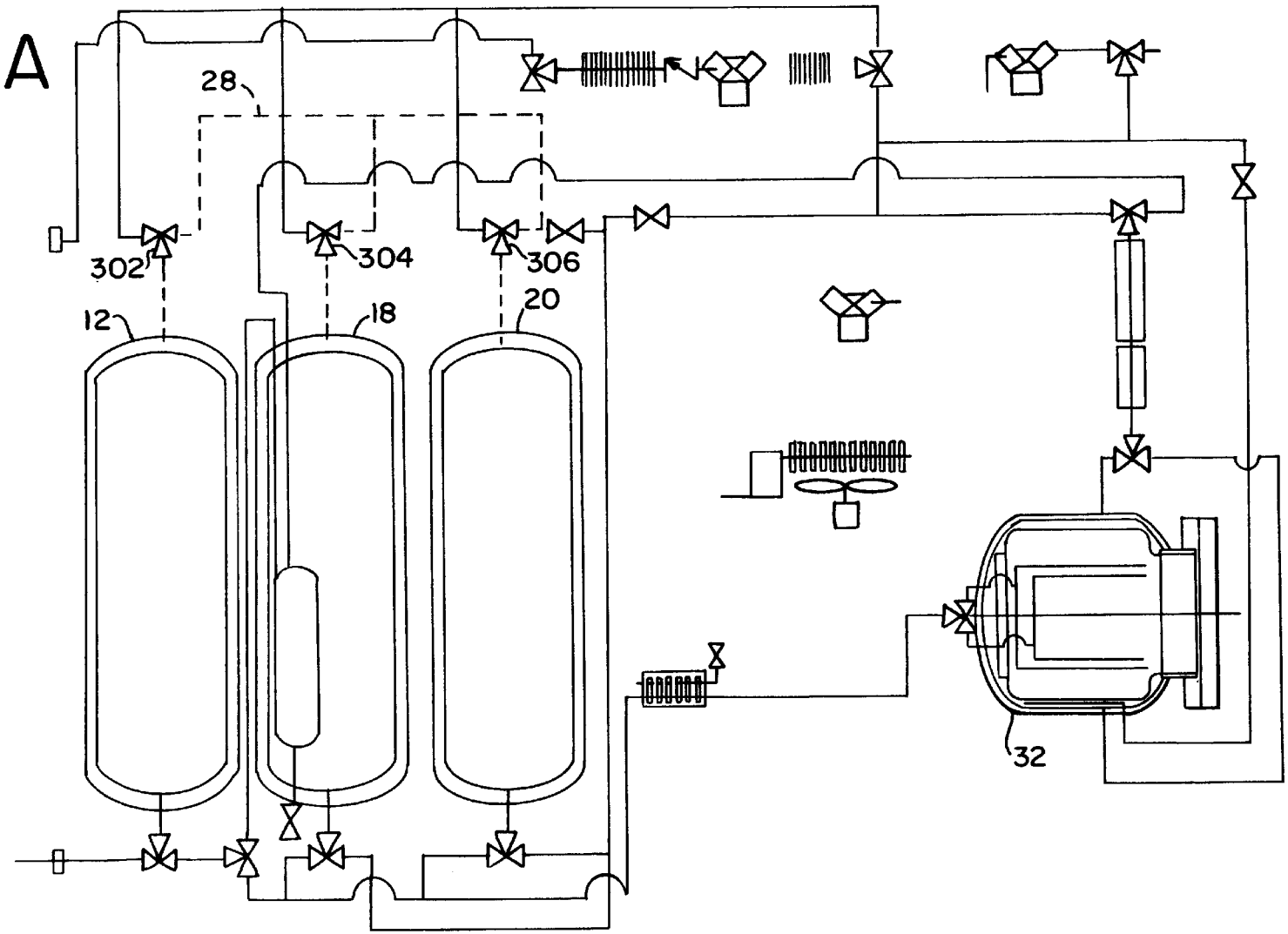

A preferred embodiment of the carbon dioxide dry cleaning system of the present invention is shown in FIG. 1A. A cold transfer tank, indicated at 12, contains a supply of liquid carbon dioxide at a pressure between 200 and 250 psi and at a temperature of approximately −15° F. Preferably, the liquid carbon dioxide contains additives to promote better cleaning and deodorizing. Transfer tank 12 is sized to hold approximately two week's worth of liquid carbon dioxide. Transfer tank 12 may be refilled from a mobile delivery tanker in a conventional manner.

High pressure storage tanks 18 and 20 contain liquid carbon dioxide at a pressure of approximately 650 to 690 psi. The two storage tanks may be refilled from transfer tank 12 when they become depleted. This may be done between each garment load or one time in the morning. To perform refilling, the head space of transfer tank 12 is initially connected to the head spaces of storage tanks 18 and 20 so that their pressures are equalized. This is shown in FIG. 1A by line 28.

Then, as shown in FIG. 1B, the head spaces of storage tanks 18 and 20 are connected to the suction side of a compressor 14. The discharge side of compressor 14 is connected to the head space of transfer tank 12. As a result, the pressure in transfer tank 12 is increased while the pressure in storage tanks 18 and 20 is decreased. This causes liquid carbon dioxide to flow at a high pressure, as indicated by thick line 30, from the liquid side of transfer tank 12 to the liquid sides of storage tanks 18 and 20.

Once storage tanks 18 and 20 are properly filled with a supply of liquid carbon dioxide, the dry cleaning process may begin. While the system of the present invention is described and discussed below in terms of dry cleaning fabrics, it is to be understood that the system may be used alternatively to perform other cleaning tasks where liquid carbon dioxide is an appropriate solvent. For example, the system could be used to degrease mechanical parts.

Referring to FIG. 1B, soiled garments or the like are placed in cleaning chamber 32. The door 34 of the cleaning chamber 32 features a seal, such as a large rubber O-ring, so that the chamber may be pressurized when the door is closed. In addition, door 34 features an interlocking system so as to prevent the door from opening while chamber 32 is pressurized. Such interlocking systems are well known in the art. Once the garments are loaded, and cleaning chamber 32 sealed, the air therein is evacuated using compressor 14, as shown by line 42 in FIG. 1B. This is done to prevent condensation when the chamber is pressurized.

Figure 1C:
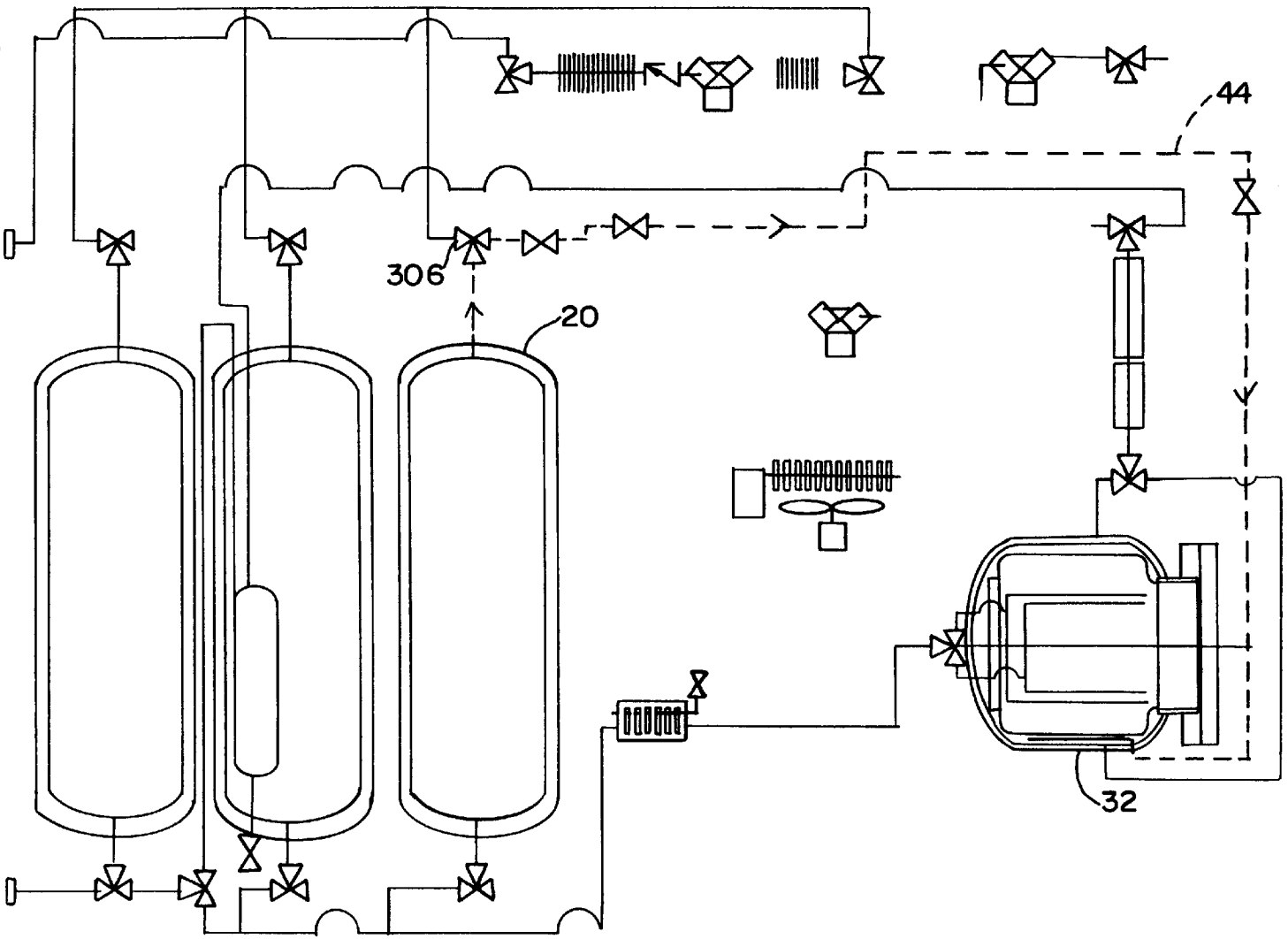

Next, as shown by line 44 in FIG. 1C, the head space of one of the storage tanks (tank 20 in FIG. 1C) is connected to the chamber so that the latter is pressurized with carbon dioxide gas to an intermediate pressure of about 70 psi. Once chamber 32 is pressurized to an intermediate pressure, it may be filled with high pressure liquid carbon dioxide without the formation of dry ice or the occurrence of extreme thermal shock.

Figure 1D:
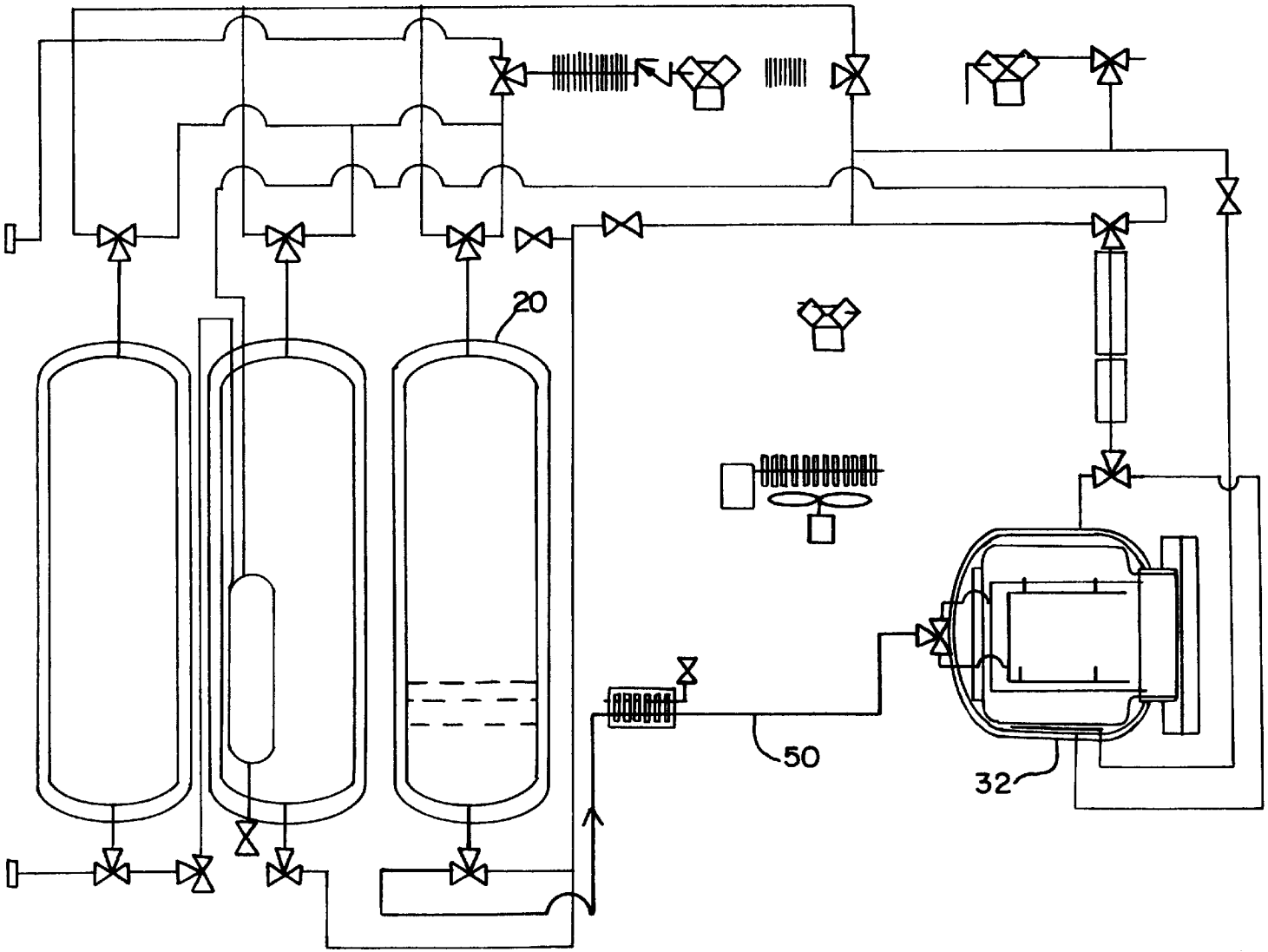
Figure 1E:
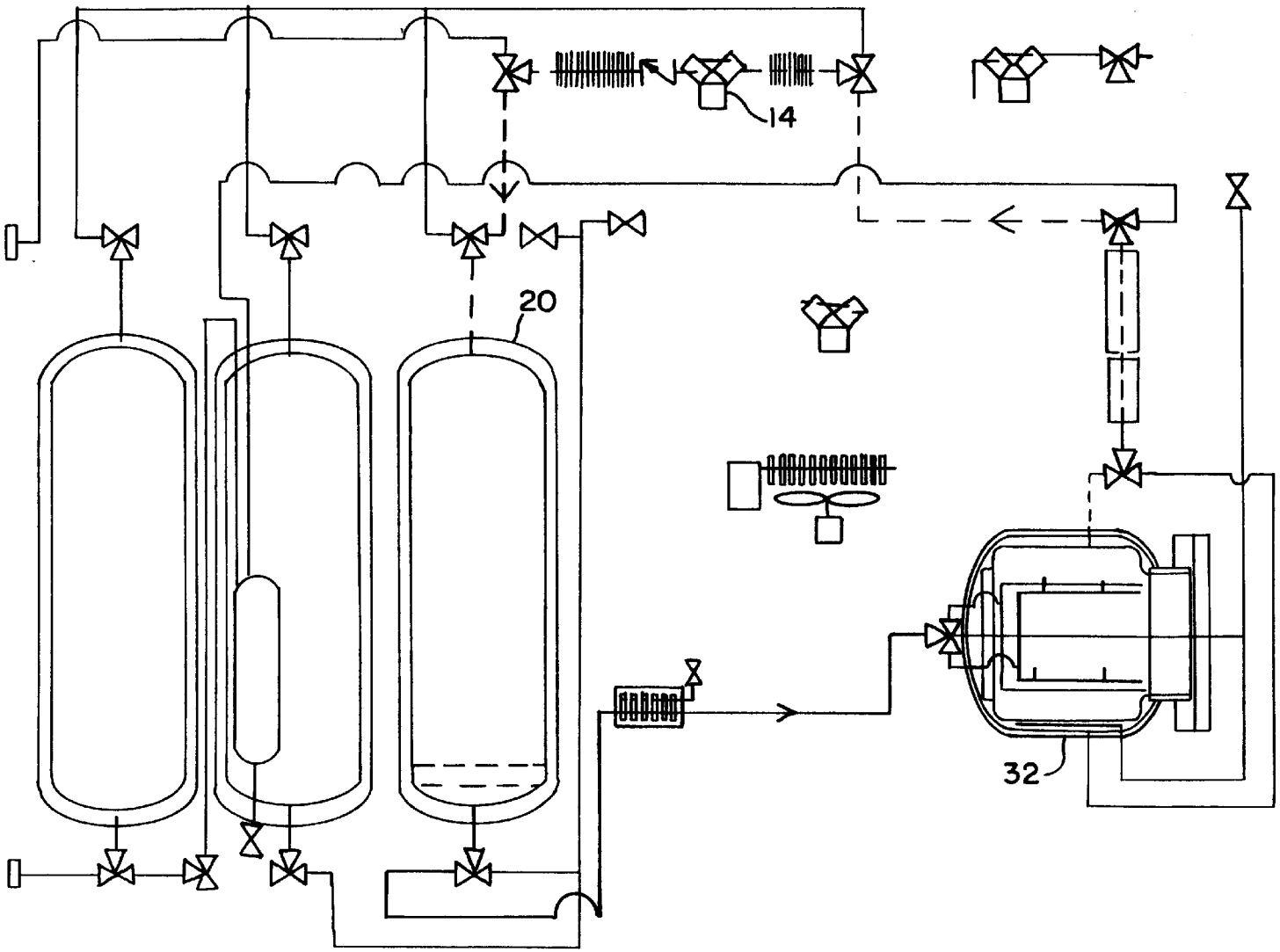

As shown in FIG. 1D, high pressure liquid carbon dioxide is then fed through line 50 via the pressure differential between storage tank 20 and cleaning chamber 32. This almost completely fills the chamber 32 without the use of a compressor or pump. Because chamber 32 and storage tank 20 (and storage tank 18) are approximately the same size, the carbon dioxide remaining in storage tank 20 may be used to finish filling chamber 32. This is accomplished, as shown in FIG. 1E, by using compressor 14 to remove carbon dioxide gas from chamber 32 and direct it back to storage tank 20. This forces the liquid carbon dioxide remaining in storage tank 20 into chamber 32 so as to completely fill it.

At this point, the liquid carbon dioxide within filled chamber 32 is at a pressure and temperature of about 650 psi and 54° F., respectively. It has been determined that liquid carbon dioxide is an effective solvent at such a temperature and that it will not harm most fabrics. The system is now ready to begin the agitation process. Agitation is necessary so that the system may remove non-soluble particles that are not removed merely by submersing the garments in the liquid carbon dioxide.

The configuration of the system during the initial portion of the agitation process is shown in FIG. 1F. The suction side of compressor 14 is connected to the top of empty storage tank 20. The discharge side of compressor 14 is connected to the head space of filled storage tank 18 so that the pressure therein is increased.

When the pressure differential between chamber 32 and storage tank 18 reaches at least 150 psi, that is, when the pressure in storage tank 18 is greater than 800 psi, high pressure liquid carbon dioxide is permitted to flow to chamber 32, as indicated by line 52. This flow is directed into chamber 32 through a first set of cleaning nozzles 53. Such nozzles are known in the art. This causes the garments and fluid in chamber 32 to rotate past the cleaning nozzles. Displaced liquid flows out of the top of chamber 32, through lint and button traps 54 and filter 56 and finally is returned to storage tank 20 at a low pressure, as indicated by cross-hatched line 58. The angles of the nozzles may optionally be adjustable from outside of the cleaning chamber 32 so that the agitation may be tailored to the specific load.

Figure 1G:
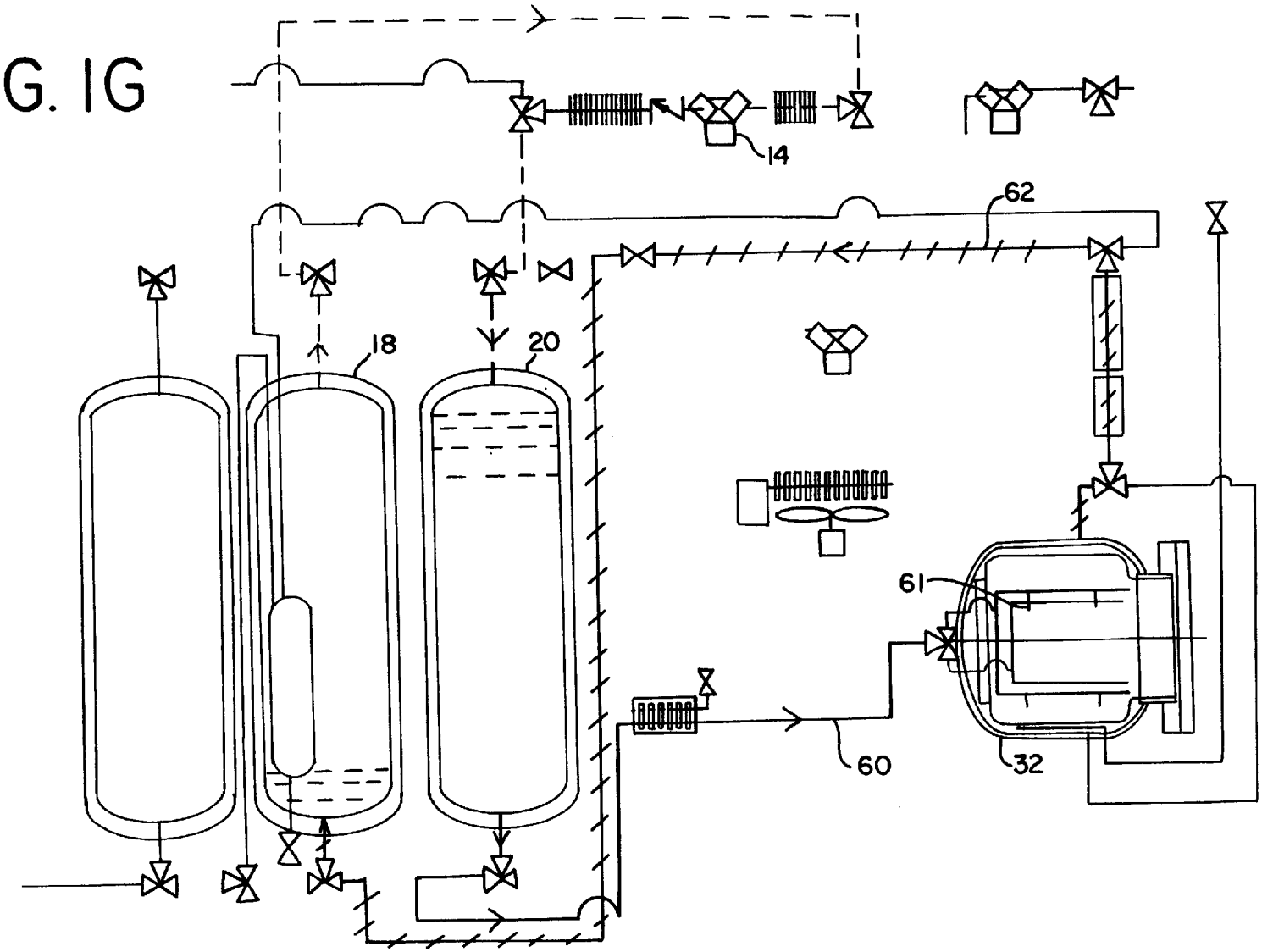

After approximately one minute, the carbon dioxide flow is terminated and the system is reconfigured as shown in FIG. 1G so that the agitation may be "reversed." More specifically, the suction side of compressor 14 is connected to the top of nearly emptied storage tank 18 while the discharge side is connected to nearly filled storage tank 20. Storage tank 20 is pressurized to over 800 psi by the flow of carbon dioxide gas.

Liquid carbon dioxide then flows out of tank 20 to chamber 32, as illustrated by line 60, where it passes through a second set of cleaning nozzles 61 that reverse the rotation of the garments. This causes the garments that have collected in the center of chamber 32 to now move to the outside where they will be subjected to the action of the cleaning nozzles. Displaced liquid flows out of the top of chamber 32 and through lint and button traps 54 and filter 56 and is returned to storage tank 18 at a low pressure, as indicated by cross-hatched line 62. The cycles of FIGS. 1F and 1G are preferably repeated approximately five to seven times for a total period of about ten to twelve minutes.

As shown in FIG. 1F, the system includes a standard refrigeration circuit, indicated generally at 64. The operation of such circuits is well known in the art. As is typical in the art, refrigeration circuit 64 features a compressor 65, fan-assisted cooling coil 66 and heat exchanger 67. Heat exchanger 67 permits refrigeration circuit 64 to cool the liquid carbon dioxide flowing to chamber 32 along line 52. As a result, heat from chamber 32 may be removed as it warms up during agitation or if it has warmed up between garment loads or overnight.

Figure 1H:
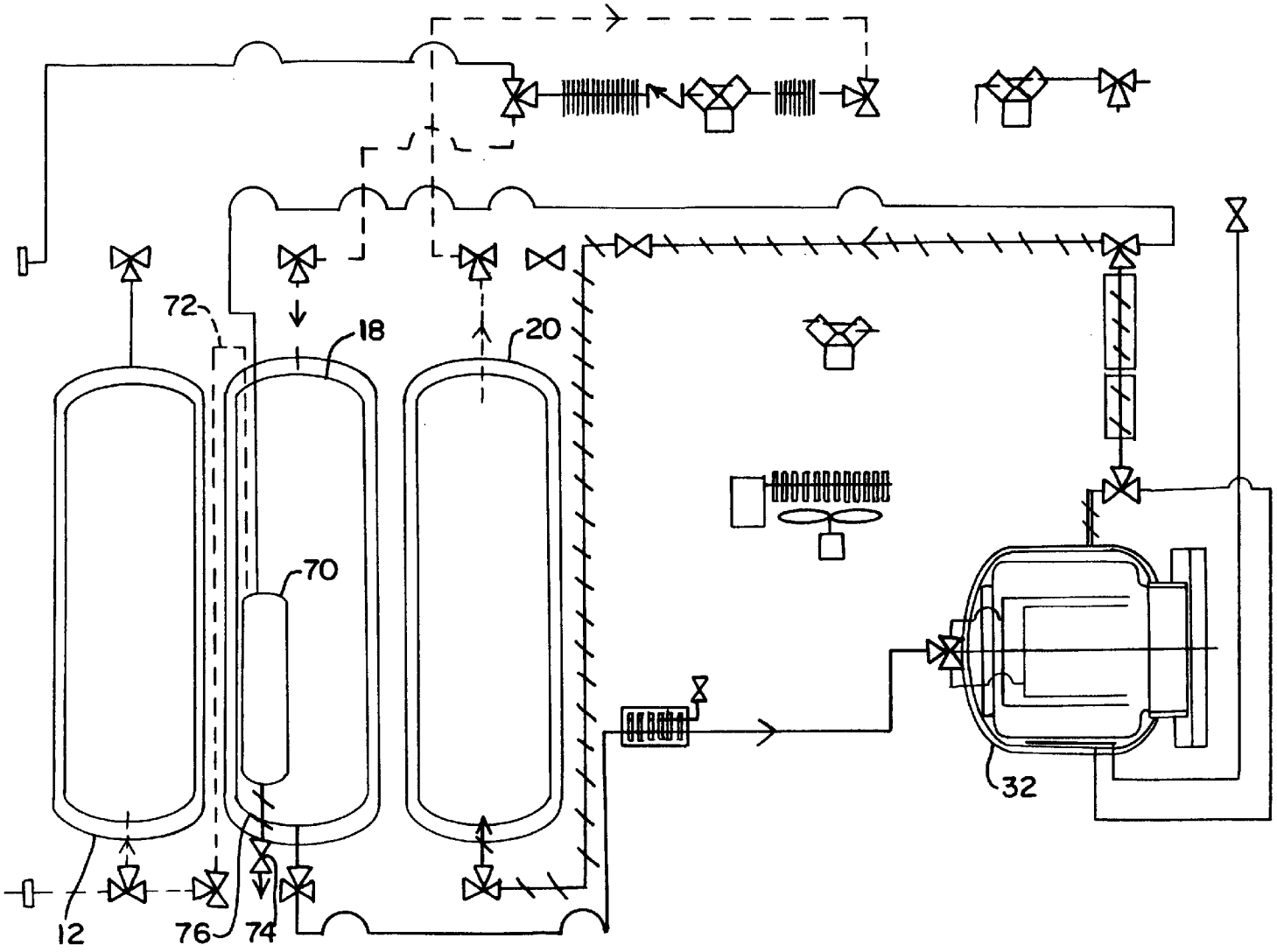
Figure 11:
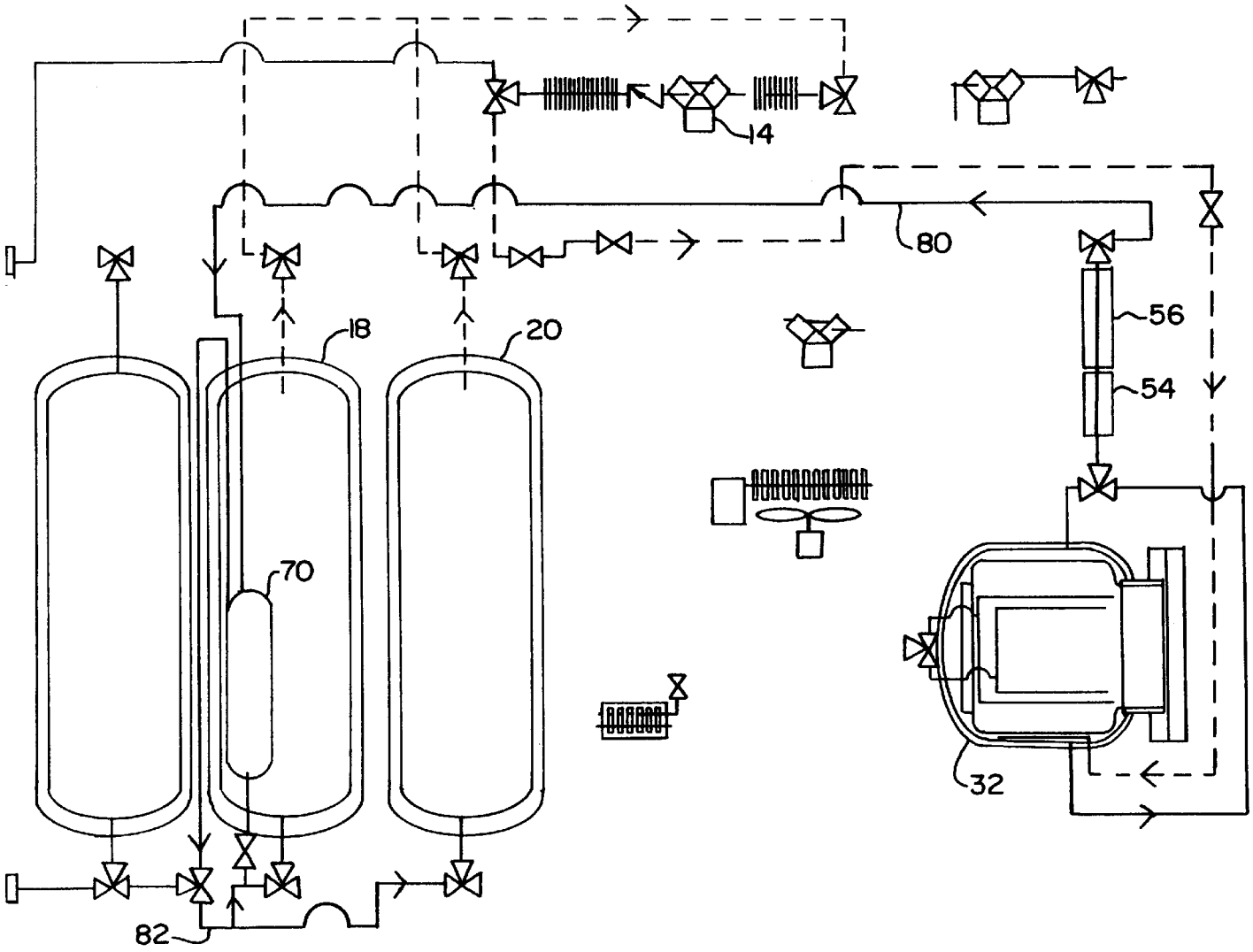

Soluble contaminants, such as soils and dyes, gradually accumulate in the liquid carbon dioxide during the agitation process and must be periodically removed. Referring to FIG. 1H, this is accomplished by still 70. Still 70, which is positioned within, for example, storage tank 18, operates during the agitation process and distills approximately 3% of the carbon dioxide in chamber 32 per load of garments.

Still 70, filled during a previous cycle in the manner described below, contains liquid carbon dioxide from chamber 32. Distillation is initiated by connecting the head space of still 70 with the liquid side of transfer tank 12. As a result, carbon dioxide gas flows to transfer tank 12 from still 70, as indicated by line 72, so that the pressure in the still is reduced. Meanwhile, as storage tanks 18 and 20 cycle through the agitation process described above, the pressure and temperature in storage tank 18 will rise so that the warmer temperature of the liquid carbon surrounding still 70 causes the liquid carbon dioxide therein to boil. As the liquid carbon dioxide in still 70 vaporizes, soil and dye residue is left behind inside the still shell. The carbon dioxide vapor flows through line 72 to transfer tank 12 where it is condensed as pure carbon dioxide.

It is necessary to drain the accumulated soil and die residue from still 70 for every garment load. This is accomplished, as shown in FIG. 1H, by opening valve 74 for approximately two seconds. This allows the pressure within still 70 to "blast" the residue out of the bottom of still, as indicated by line 76, where it is collected in a container for disposal.

After the completion of the agitation process, it is necessary to refill still 70 with liquid carbon dioxide from chamber 32. This may be accomplished in the manner illustrated in FIG. 1I. The suction side of compressor 14 is connected to the head spaces of storage tanks 18 and 20, while the discharge is connected to chamber 32. Accordingly, compressor 14 extracts gas from tanks 18 and 20 and uses it to pressurize chamber 32. As indicated by line 80, this causes the liquid carbon dioxide in chamber 32 to flow to still 70, through lint and button traps 54 and filter 56 so that still 70 is filled and pressurized to approximately 650 to 690 psi. Once still 70 is filled with liquid carbon dioxide, the remaining liquid carbon dioxide from chamber 32 is routed, via line 82 to storage containers 18 and 20. By draining chamber 32 in this manner, there is a reduced possibility of liquid entrapment or ice formation.

At this point, chamber 32 is at a pressure of about 650 psi and is empty of carbon dioxide liquid, except for a small amount trapped between the fibers of the garments. The remaining liquid in the garments may be removed in the manner illustrated in FIGS. 1J and 1K. As illustrated in FIG. 1J, the suction side of compressor 14 is connected to chamber 32, while the discharge side is connected to the head spaces of storage tanks 18 and 20. Compressor 14 is then activated so that the pressure in chamber 32 is reduced to about 420 psi. As this occurs, the pressure in storage tanks 18 and 20 is increased to about 670 psi.

Figure 1K:
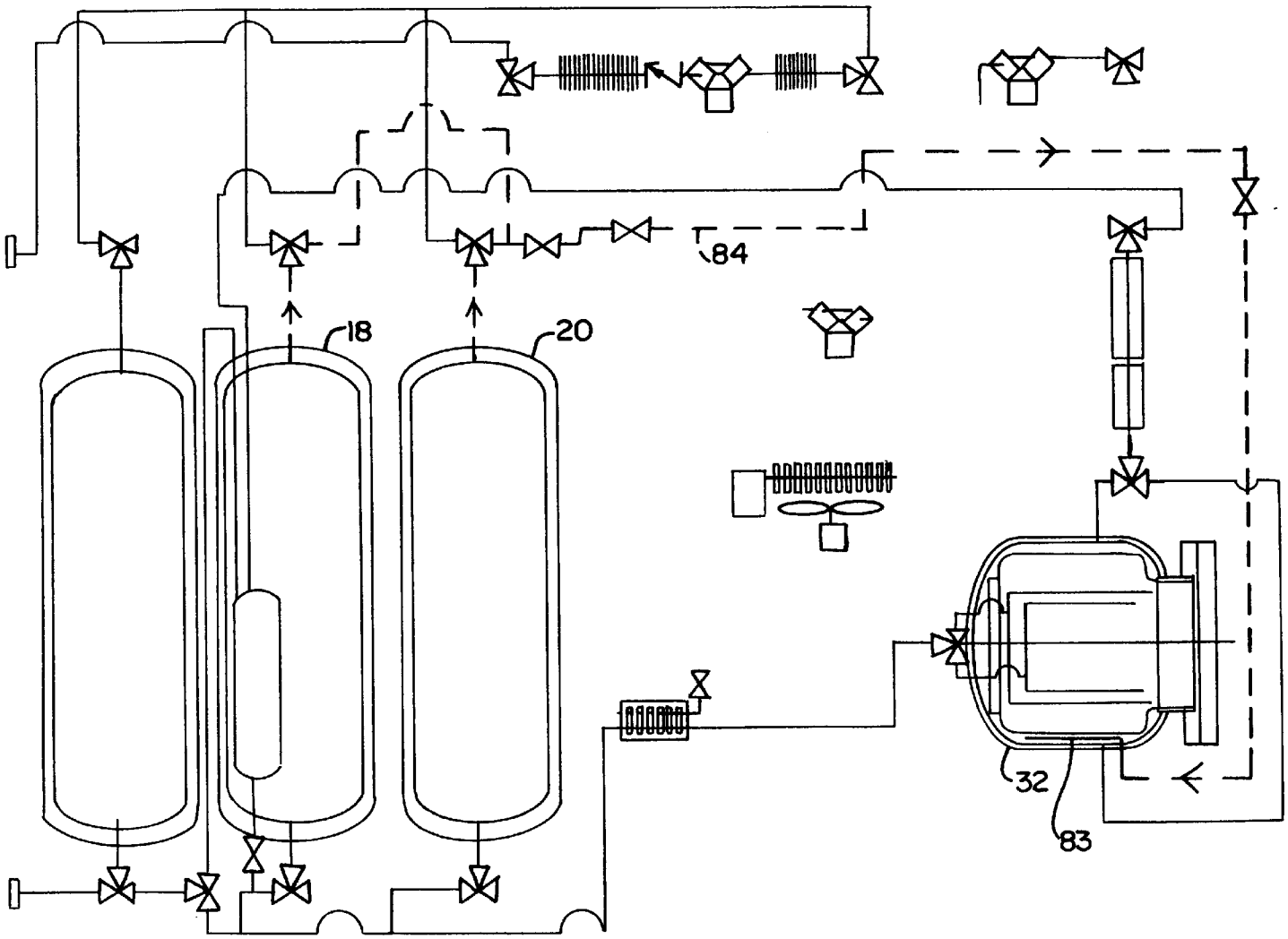
Figure 11:
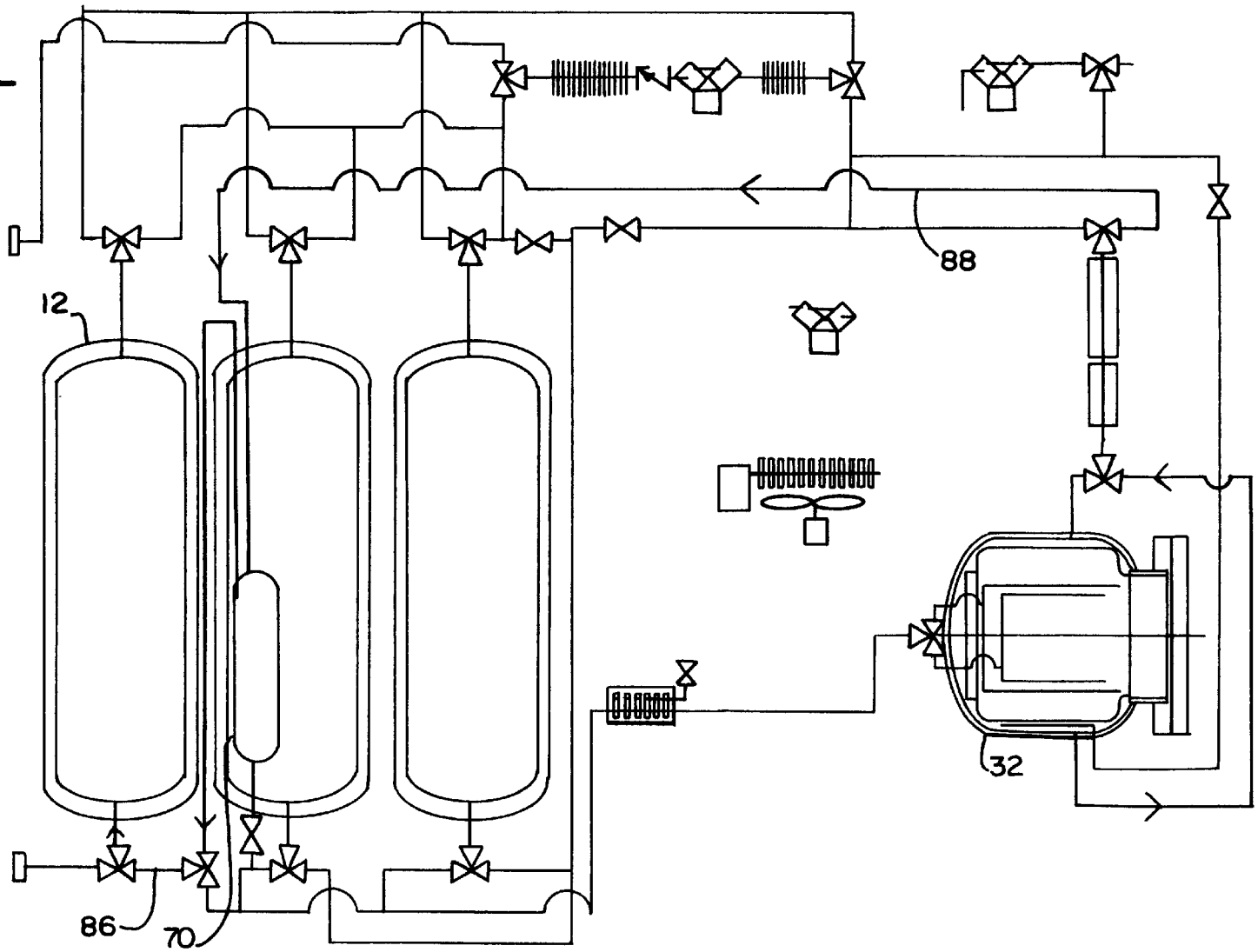

Next, as shown in FIG. 1K, the head spaces of storage tanks 18 and 20 are connected to a set of blasting jets 83 in the bottom of chamber 32. Such jets are known in the art. The approximately 250 psi pressure difference between storage tanks 18 and 20 and chamber 32 causes the latter to be repressurized with a blast of gas that passes through the jets and directly into the garments. This is illustrated by line 84 in FIG. 1K. By repeating the procedure of FIGS. 1J and 1K, the carbon dioxide liquid within the garments is removed and the garments are "fluffed." Testing has shown that two such "blasts" are usually sufficient to remove nearly all of the liquid carbon dioxide from the garments.

After the last "blast" of carbon dioxide gas, chamber 32 contains the liquid carbon dioxide removed from the garments and is at a pressure of about 650 psi. The liquid removed from the garments contains an abundance of soil and dies and thus requires distillation. To transfer this liquid to still 70, the method illustrated in FIG. 1L is employed. First, still 70 is connected to transfer tank 12. The pressure difference between the two causes a portion of the liquid carbon dioxide in still 70 to flow to transfer tank 12 as indicated by line 86. This decreases the pressure within still 70 so that it is significantly below the pressure of chamber 32. As a result, the liquid within chamber 32 is transferred to still 70 as indicated by line 88.

Figure 1M:
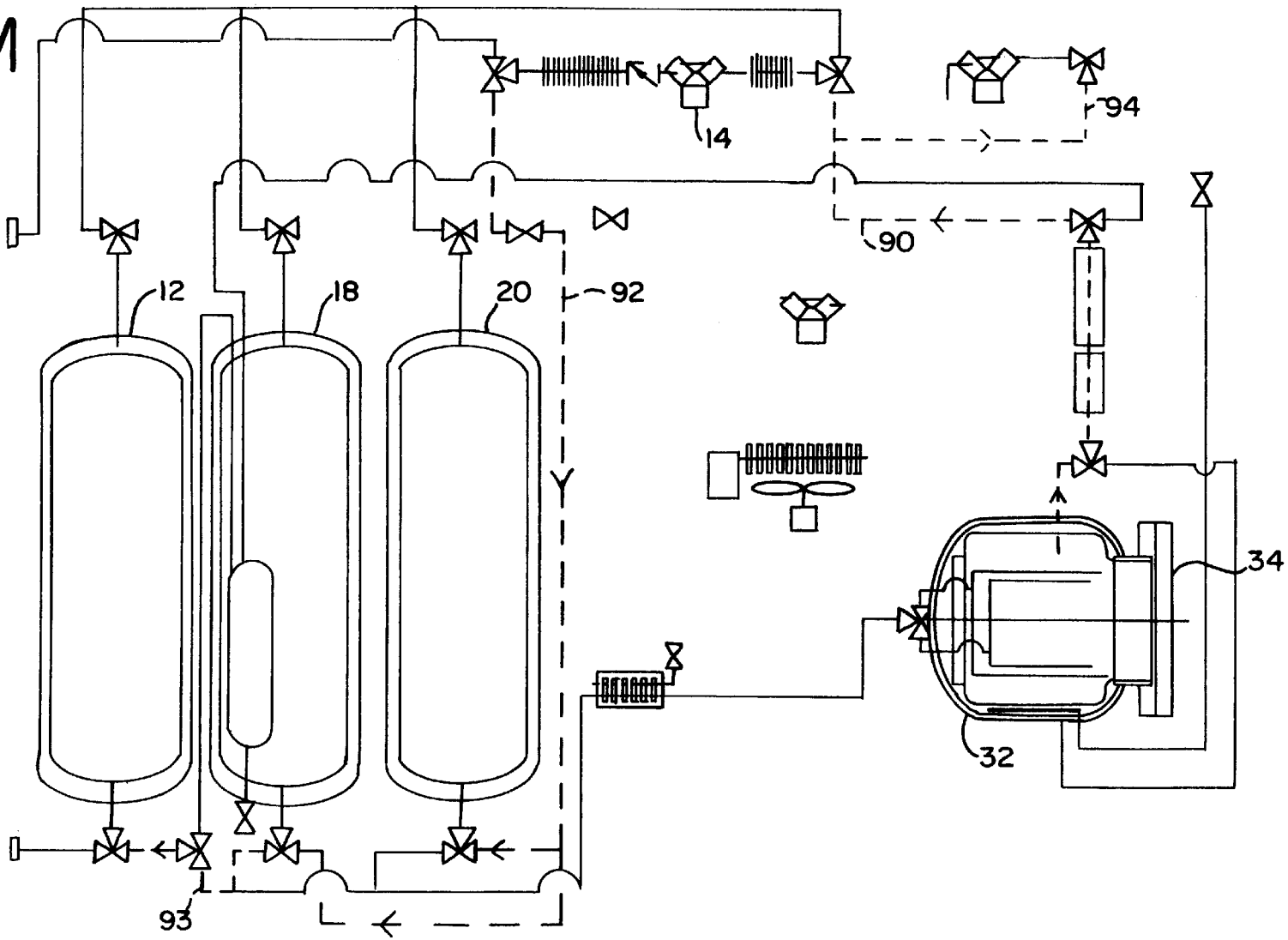

Referring to FIG. 1M, with the dry cleaning process now complete, chamber 32 must be depressurized so that the chamber door 34 may be opened and the garments removed. Accordingly, the suction side of compressor 14 is connected to chamber 32 while the discharge side is connected to storage tanks 18 and 20. The carbon dioxide gas within chamber 32 is then extracted and used to pressurize storage tanks 18 and 20 back up to approximately 650 to 690 psi, as indicated by lines 90 and 92. Fine screen diffusers, which are known in the art, may be placed in the bottom of the storage tanks so that the gas returned will be more efficiently diffused into the liquid. When the pressure in chamber 32 drops to 400 psi, the discharge side of compressor 14 is preferably configured via line 93 to deliver gas solely to transfer tank 12. This is done so that compressor 14 is not overloaded and heat is not produced. After chamber 32 is depressurized, the pressure therein is approximately 50 to 65 psi. At this pressure, chamber 32 contains less than 1% of the carbon dioxide that it contained when it was full. Accordingly, chamber 32 may be vented to the atmosphere, as indicated by line 94, without causing significant waste. With the chamber at atmospheric pressure, chamber door 34 may be safely opened and the garments removed.

The various configurations described above, and illustrated in FIGS. 1A through 1M, are achieved by the manipulation of a number of valves. For example, in reference to FIG. 1A, valves 302, 304 and 306 control communication with the head spaces of tanks 12, 18 and 20, respectively. Such valves are well known in the art.

Control of the system valves preferably is automated by way of a microcomputer. More specifically, the sequencing of the valves, so that the system operates as described above, is preferably controlled by a microcomputer that is responsive to signals generated by temperature, pressure and liquid level sensors positioned within tanks 12, 18 and 20 and cleaning chamber 32. The microcomputer preferably includes a timer as well that allows it to configure the valves for a predetermined period of time. Such microcomputers and their operation are known to those skilled in the art. Suitable microcomputers are available, for example, from the Z-World corporation of Davis, Calif.

Referring to FIG. 1C, for example, as carbon dioxide gas flows into chamber 32 through valve 306, and the other open valves along line 44, a sensor within chamber 32 monitors the pressure therein. When this pressure sensor detects that the pressure within chamber 32 has risen to 70 psi, it sends a signal to a microprocessor which in turn closes valve 306, and the other valves along line 44, so that the flow of carbon dioxide gas into chamber 32 ceases.

As another example, as agitation is being performed in the manner illustrated in FIG. 1F, a timer tracks the time interval. When one minute has passed, the timer signals a microprocessor which then reconfigures the valves to the arrangement shown in FIG. 1G so that agitation may be reversed. Alternatively, pressure sensors positioned within storage tank 18 and cleaning chamber 32 may signal a microprocessor to reconfigure the system valves to the arrangement shown in FIG. 1G when a pressure drop across the cleaning nozzles 53 (FIG. 1F) occurs. A pressure sensor positioned in storage tank 20 may be used in combination with the pressure sensor in the cleaning chamber to accomplish a similar function.

Figure 4:
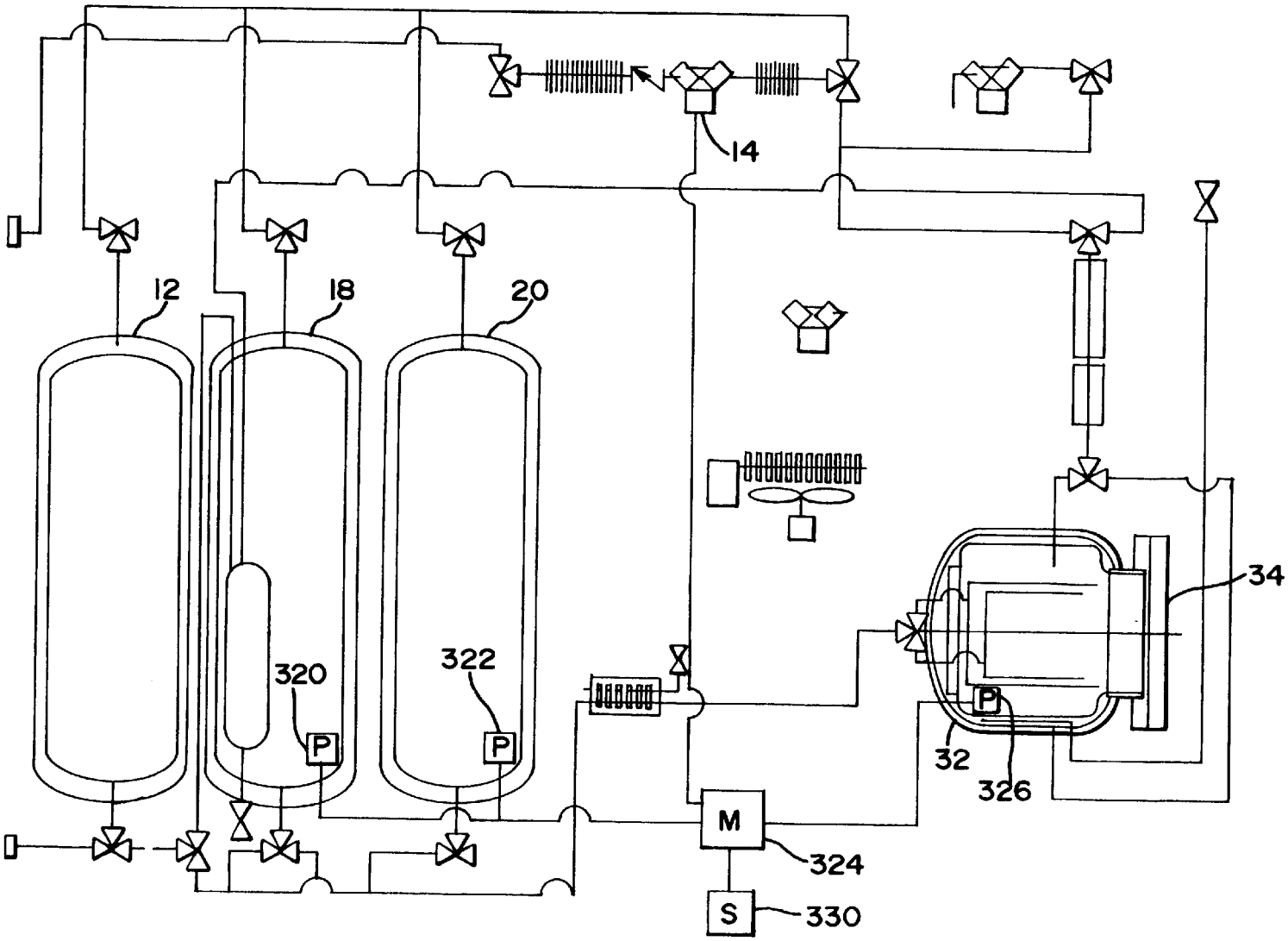
FIG. 4 is a schematic diagram of the embodiment of the carbon dioxide dry cleaning system of FIGS. 1A–1M showing the agitation pressure control system.

The pressure sensors within the storage tanks 18 and 20 and cleaning chamber 32 may also be utilized to control the pressure across the nozzles 53 (FIG. 1F) and 61 (FIG. 1G), that is, the agitation pressure, so that delicate fabrics or objects are not damaged during agitation. This may be accomplished using the agitation control system illustrated in FIG. 4. The pressure sensors 320 and 322 in tanks 18 and 20, respectively, are in communication with a control means such as microprocessor 324. The control means may alternatively take the form of a process controller such as those made by the Allen Bradley Company or a similar device. A pressure sensor 326 in cleaning chamber 32 is also in communication with the microprocessor. A selector means such as switch 330 allows an operator to select, for example, a fabric setting that is communicated to the microprocessor. During the agitation cycle, the microprocessor adjusts the loading of the compressor 14 based upon the setting of switch 330 so that the pressure differential between the tanks 18 and 20, when pressurized, and the chamber 32 is controlled. As a result, the pressures from the nozzles in the cleaning chamber are controlled.

As is known in the art, differential pressure gauges may be utilized to determine the liquid levels within the storage tanks 18 and 20. When liquid carbon dioxide under high pressure is contained within the storage tanks, however, condensation may form in the normally gas-filled external tubes of the differential pressure gauges so as to provide erroneous readings. To prevent this problem, the external tubes of the differential pressure gauges may be equipped with heaters in communication with temperature controllers. Heating the external tubes prevents the condensation.

The system of FIGS. 1A through 1M offers significant advantages over other carbon dioxide dry cleaning systems. The system moves the liquid carbon dioxide without the use of pumps, instead relying upon a single compressor to pressurize the appropriate carbon dioxide storage tanks with carbon dioxide gas. The density of gaseous carbon dioxide is only about one-sixth of the density of liquid carbon dioxide at the pressures involved. As a result, much less mass is moved by the compressor in motivating the liquid carbon dioxide than if pumps moved the liquid directly. By handling less mass, the compressor suffers less wear and thus offers greater reliability and lower maintenance requirements as compared to cryogenic pumps. In addition, such compressors generally cost less than pumps.

The still 70 is advantageous over the distillation apparatus'of other carbon dioxide dry cleaning systems in that it does not employ an electric heater or a heat exchanger. This increases its reliability while decreasing its cost and maintenance requirements. Accordingly, while the preferred embodiment of the system of the present invention is pumpless, the advantages of still 70 may be utilized in systems that feature pumps. Examples of such systems are presented in FIGS. 2 and 3.

Figure 2:
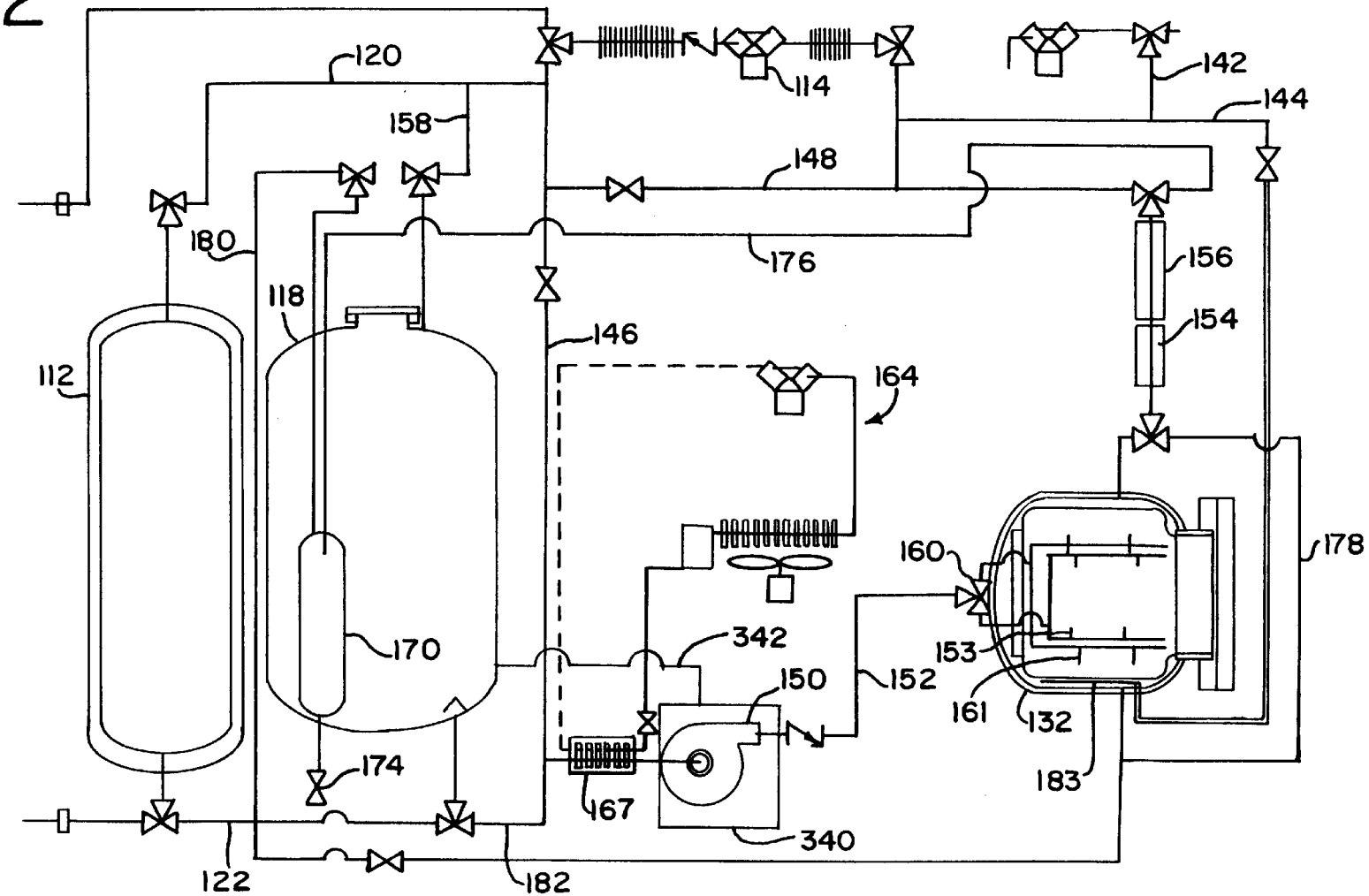
FIG. 2 is a schematic diagram of another embodiment of the carbon dioxide dry cleaning system of the present invention wherein two carbon dioxide tanks and a pump in a sump are used.

In FIG. 2, a second embodiment of the carbon dioxide dry cleaning system of the present invention is shown. With the exception of the agitation and distillation processes, this system operates in a manner similar to the system of FIGS. 1A through 1M. A cold transfer tank 112 contains a supply of liquid carbon dioxide, preferably with cleansing additives, at a pressure of about 200 to 250 psi. Transfer tank 112 may be refilled from a mobile delivery tank in a conventional manner.

Transfer tank 112 is used to refill a storage tank 118. This is accomplished by first equalizing the pressures in the two tanks with line 120. Next, the suction side of a compressor 114 is connected to the storage tank 118 while the discharge side is connected to transfer tank 112. This creates a pressure differential between the two tanks so that liquid carbon dioxide travels to storage tank 118 through line 122.

A cleaning chamber 132 contains soiled garments and has a volume less than that of storage tank 118. To commence the dry cleaning process, most of the air in chamber 132 must be evacuated to prevent the addition of water to the cleaning fluid. This is accomplished through line 142, as shown with line 42 in FIG. 1B. Chamber 132 is then pressurized to an intermediate pressure of approximately 70 psi by placing it in communication with the head space of transfer tank 118 so that gas travels through line 144 (as in FIG. 1C).

Chamber 132 may next be filled with liquid carbon dioxide. The liquid side of storage tank 118 is connected to the bottom of chamber 132 with lines 146, 148 and 144. The pressure difference between tank 118 and chamber 132 then causes the latter to be almost completely filled with liquid carbon dioxide. The fill is completed by connecting chamber 132 to the suction side of compressor 114 and connecting the discharge side to storage tank 118. This allows gas to be extracted from chamber 132 and storage tank 118 to be pressurized. The resulting pressure difference causes liquid carbon dioxide to flow from storage tank 118 to chamber 132 through pump line 152. This pre-cools pump 150 for the agitation process, described below.

At this point, chamber 132 is filled with liquid carbon dioxide at a pressure of about 650 to 690 psi and a temperature of about 54° F. (a temperature at which it is an effective solvent). Pump 150 is activated to initiate the agitation process so that insoluble soils may be removed from the garments. Liquid carbon dioxide is pumped by pump 150 through pump line 152 to a first set of cleaning nozzles 153 in chamber 132. As explained in reference to FIGS. 1F and 1G above, these nozzles cause the garments and fluid in chamber 132 to rotate past the cleaning nozzles. Displaced liquid flows out of the top of chamber 132, through lint and button trap 154 and filter 156 and finally is returned to the top of storage tank 118 via lines 148 and 158.

After approximately one minute, valve 160 is adjusted so that the flow of liquid carbon dioxide is directed to a second set of cleaning nozzles 161. These nozzles reverse the rotation of the liquid and garments in chamber 132. After approximately one minute, valve 160 is reconfigured so that the first set of cleaning nozzles 153 are again utilized. Valve 160 is cycled in this manner preferably five to seven times for a total period of about ten to twelve minutes.

The system of FIG. 2 also features a refrigeration circuit, indicated generally at 164. This refrigeration circuit features a heat exchanger 167 that allows heat to be removed from the liquid carbon dioxide flowing through pump line 152.

A still, indicated at 170, contains liquid carbon dioxide that was transferred to it during the cleaning of a previous load of garments. As the agitation process is proceeding, the head space of still 170 is connected to the suction side of compressor 114. The discharge side of compressor 114 is connected to the head space of storage tank 118. As a result, the pressure within still 170 is decreased while the pressure in storage tank 118 is increased. Alternatively, still 170 may be connected to the liquid side of low pressure transfer tank 112. As a result, gas from still 170 flows to transfer tank 112 where it is recondensed by the cold liquid therein. In either case, the pressure difference created between still 170 and storage tank 118 allows the temperature of the liquid carbon dioxide in tank 118 to cause the liquid carbon dioxide in still 170 to boil.

As boiling occurs, the residue of soluble contaminants, such as soils and dyes, is left behind in still 170 while the carbon dioxide vapor is routed to storage tank 118. As a result, this distillation process cools storage tank 118 while simultaneously cleaning the carbon dioxide. In addition, the pressure within storage tank 118 is increased by the vapor from still 170. For every garment load, valve 174 is opened for about two seconds to "blast" the accumulated soil and die residue from still 170 into a container for disposal.

Upon completion of the agitation process, the suction side of compressor 114 is connected to storage tank 118 while the discharge side is connected to chamber 132. The bottom of chamber 132 is connected to still 170 by lines 176 and 178. As a result, approximately 3% of the liquid carbon dioxide in chamber 132 is transferred to still 170 so as to pressurize it to about 650 to 690 psi for distillation during the next cleaning load. In addition, still 170 is connected to storage tank 118 by line 180. Accordingly, once still 170 is full, the remaining liquid carbon dioxide from chamber 132 is transferred to storage tank 118 so that chamber 132 is drained.

The pressure within chamber 132 is next decreased to about 420 psi by connecting it to the suction side of compressor 114. The discharge side of compressor 114 is connected to storage tank 118. As a result, the pressure in storage tank 118 is increased to about 650 to 690 psi while the pressure in chamber 132 drops to about 420 psi. The resulting approximately 250 psi pressure differential allows gas to be blasted through blasting jets 183, positioned in the bottom of chamber 132, and into the garments, via lines 158, 148 and 144, so that liquid within the garment fibers is removed. Preferably this cycle is repeated twice. The liquid carbon dioxide from the garments is then transferred from chamber 132 to still 170 in the manner described above in reference to FIG. 1L.

With the cleaning process completed, the garments are ready to be removed from chamber 132. Before this may be safely done, the pressure within chamber 132 must be reduced to atmospheric. This is accomplished by first connecting chamber 132 to the suction side of compressor 114 and the discharge side of compressor 114 to the liquid side of storage tank 118. As a result, the carbon dioxide gas from chamber 132 is bubbled into the liquid carbon dioxide of storage tank 118. When the pressure within chamber 132 drops to 400 psi, the discharge side of compressor 114 is preferably configured to deliver gas solely to transfer tank 112. As a result, the pressure within chamber 132 is reduced to approximately 50 to 65 psi. The remaining carbon dioxide gas in chamber 132 may then be vented to the atmosphere and the chamber safely opened.

Figure 3:
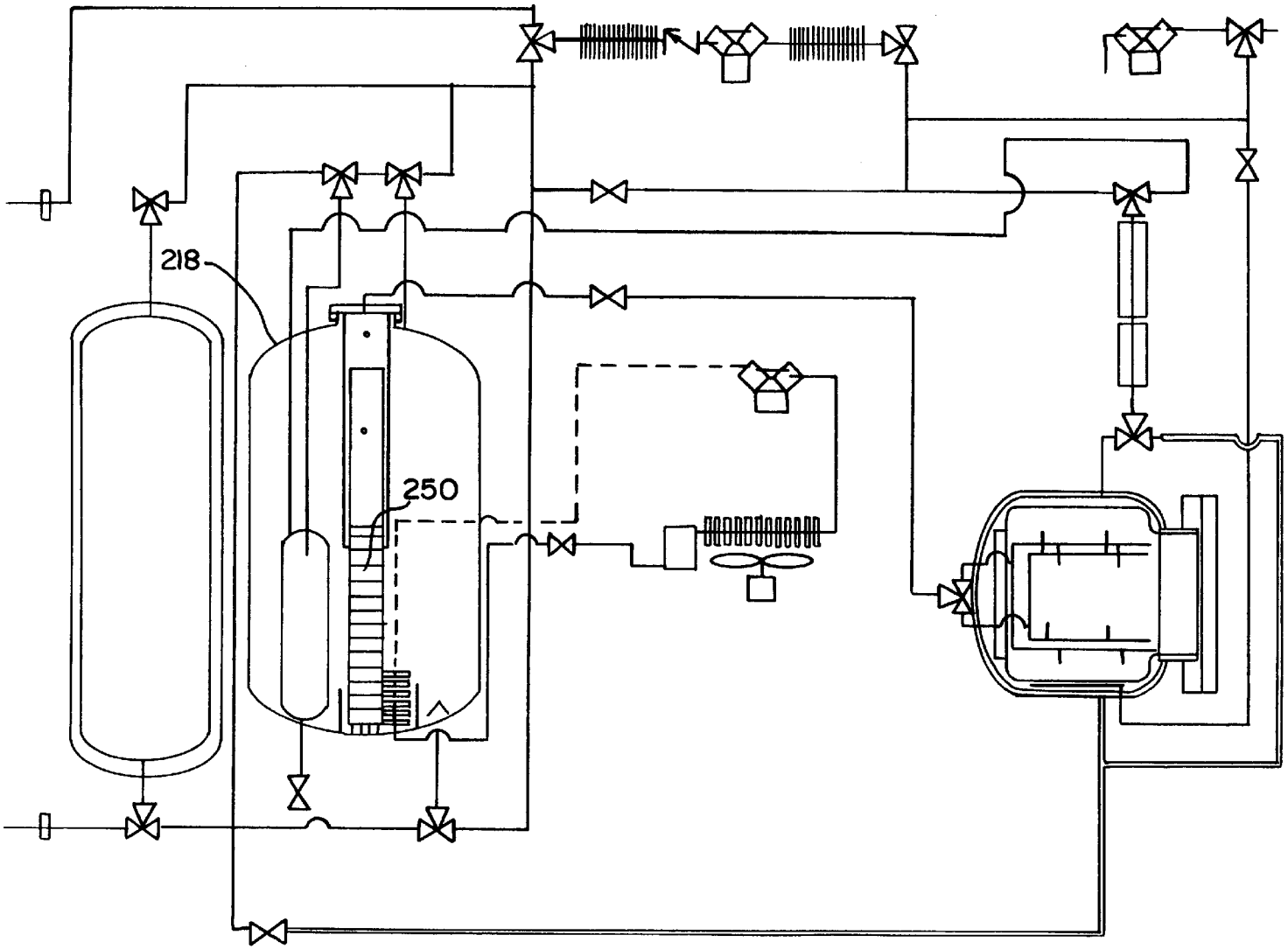
FIG. 3 is a schematic diagram of a third embodiment of the carbon dioxide dry cleaning system of the present invention wherein a pump is disposed within the high pressure carbon dioxide storage tank.

In FIG. 3, an embodiment of the system is shown wherein the system pump 250 is disposed within the storage tank 218. The system of FIG. 3 operates in exactly the same manner as the system of FIG. 2, except that it offers the benefits of internal pump placement. More specifically, by placing pump 250 within storage tank 218, the pressure differential between the interior and exterior of the pump is greatly reduced. This extends the life of seals around the pump shaft so that the seal replacement intervals are drastically reduced.

As an alternative to placing the pump in the storage tank, the pump may be placed in a sump, illustrated at 340 in FIG. 2. The sump receives solvent from the storage tank 118 via line 342 so that the pump remains submersed. Such an arrangement allows the pump to be readily replaced or serviced without emptying the supply tank 118. The sump could be mounted in a rotatable fashion so that it could be used in a vertical position and then drained and rotated to a horizontal position. This would allow a tall multistage pump that cannot be removed when vertical to be replaced or serviced.

The systems of FIGS. 2 and 3, like the system of FIGS. 1A through 1M, feature a number of control valves. The operation of these valves may also be automated by the use of a microcomputer, process controller or similar device.

Figure 5:
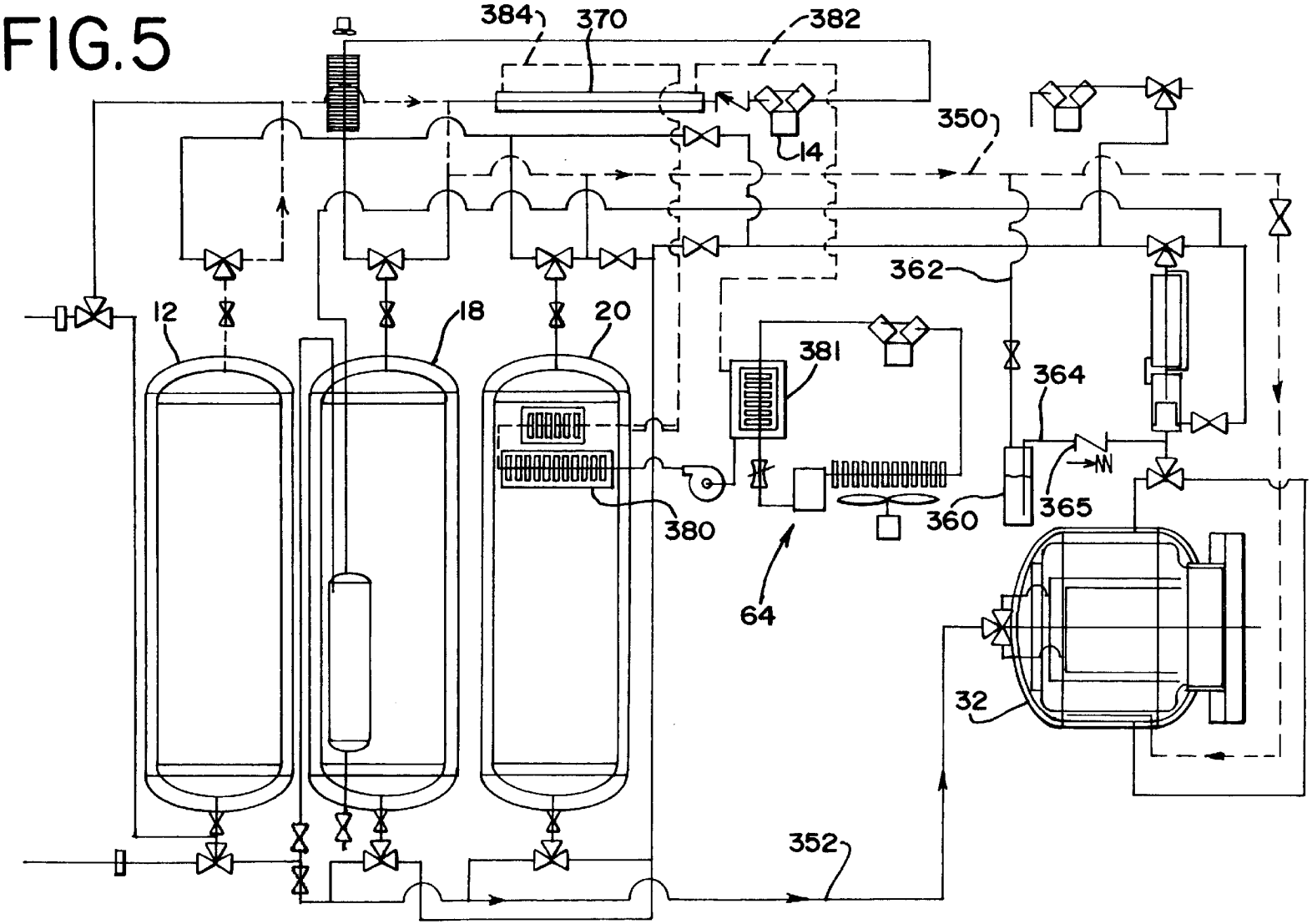
FIGS. 5 and 6 are schematic diagrams of a fourth embodiment of the carbon dioxide dry cleaning system of the present invention including a heat sink, recondensing coils in one of the storage tanks and a solvent additive dispenser.

FIG. 5 shows an alternative embodiment of the system of the present invention. With the exception of the features discussed below, the system of FIG. 5 operates in the same manner as the system of FIGS. 1A–1M. Accordingly, components that are common between FIG. 5 and FIGS. 1A–1M will feature the same reference numbers.

As described earlier in reference to FIG. 1C, the head space of either storage tank 18 or 20 may be temporarily connected to the cleaning chamber 32. As a result, the cleaning chamber is pressurized so that it may be filled with liquid carbon dioxide without the formation of dry ice or the occurrence of thermal shock. Alternatively, as illustrated by line 350 in FIG. 5, the head space of transfer tank 12 may be connected to the cleaning chamber 32 to accomplish the same result. In addition, as illustrated by line 352, liquid carbon dioxide from the transfer tank may be added to the cleaning chamber. This may be done at the beginning of a cleaning cycle, that is, immediately after the processes illustrated in FIG. 1C or by line 350 in FIG. 5, to replenish the solvent lost during the previous cleaning cycle. As a result, solvent may be added to the system without the use of a pump or compressor.

Additives for enhancing cleaning such as surfactants, anti-static agents, detergents and deodorants may be injected into the liquid carbon dioxide via the solvent additive dispenser indicated at 360 in FIG. 5. The dispenser contains a supply of additive with a head space thereabove. The dispenser head space may be placed in communication with the head space of either storage tank 18 or 20 via line 362. The liquid side of the dispenser may be accessed either internally by a dip tube or externally through a port so that the additive may travel through line 364. As a result, during agitation (FIG. 1F), the dispenser is pressurized as tank 18 (for example) is pressurized so that additive is injected into the liquid carbon dioxide traveling from the cleaning chamber 32 to storage tank 20.

As illustrated in FIG. 5, line 364 features a check valve 365 that prevents liquid carbon dioxide from reaching the additive dispenser 360. This prevents the formation of dry ice in the additive dispenser 360 when the dispenser is depressurized for replenishment of the solvent additive.

As indicated at 370 in FIG. 5, a heat sink is connected to the outlet of the compressor 14. Heat from the compressed carbon dioxide gas exiting the compressor is transferred to the heat sink during the agitation (FIGS. 1F and 1G) and chamber pressure reduction (FIG. 1J) cycles. As a result, the carbon dioxide gas is cooled before it enters storage tanks 18 and 20. The undesired heating of the solvent in the storage tanks is therefore minimized.

Figure 6:
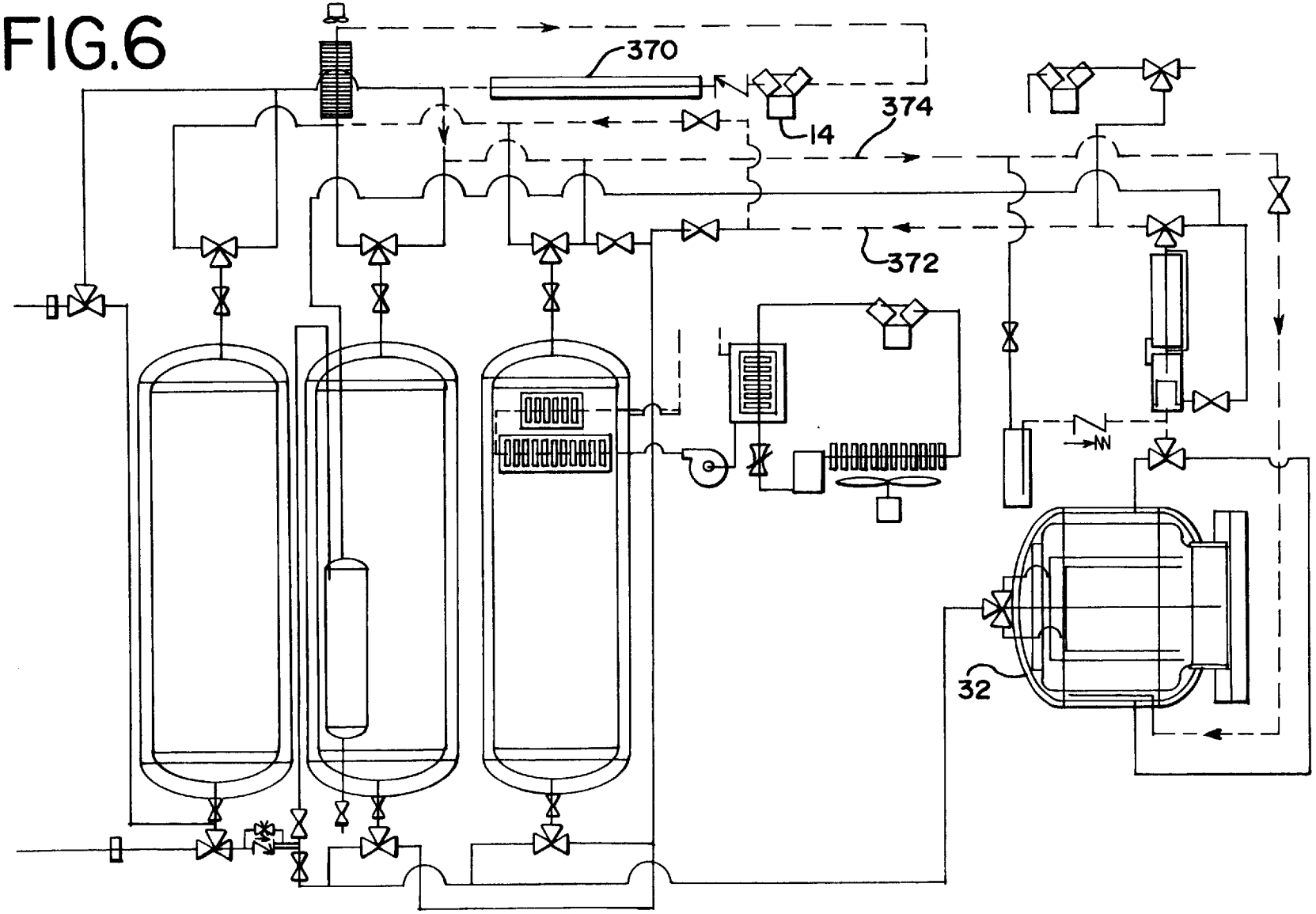

The interior of the cleaning chamber is cooled as a result of the pressure reduction of FIG. 1J. Carbon dioxide gas within the cleaning chamber may be circulated through the heat sink 370 and returned to the cleaning chamber, as illustrated by lines 372 and 374 in FIG. 6. The circulated carbon dioxide gas is warmed by the heat sink so that the interior of the chamber is warmed. As a result, the removal of solvent from the cleaning chamber contents is enhanced. Heat sink 370 therefore acts as a "thermal battery" by storing the heat from previous cycles for use in warming the cleaning chamber. The compressor 14 is run at very low compression during this circulation.

As explained in reference to FIG. IF, a refrigeration circuit 64 may be used to cool liquid carbon dioxide as it flows to the cleaning chamber. This allows the chamber to be cooled if it has warmed up between garment loads or overnight. Alternatively, as illustrated in FIG. 5, a recondensing coil 380 may be placed within storage tank 20. The recondensing coil communicates with the refrigeration circuit 64 via a heat exchanger 381. This allows the liquid carbon dioxide within storage tank 20 to be cooled before it is transferred to the cleaning chamber. As a result, the cleaning chamber is cooled as it receives the cooled liquid carbon dioxide. As indicated by lines 382 and 384, the heat sink 370 may also communicate with the refrigeration circuit 64 via heat exchanger 381. This allows the temperature of the heat sink to be controlled.

Boiling the liquid carbon dioxide in the cleaning chamber increases the effectiveness of the cleaning process. In other words, objects are more thoroughly cleaned when the liquid carbon dioxide in the chamber is boiled. This may be accomplished as follows. After the initial fill of the cleaning chamber 32 with liquid carbon dioxide, illustrated in FIG. 1E, the line leading from the liquid side of the storage tank 20 is closed. The line between the cleaning chamber and the head space of the storage tank 20, with the compressor 14 in circuit therebetween, remains open. The compressor may then be utilized to lower the pressure within the cleaning chamber to below the saturation pressure for the liquid carbon dioxide. This causes the liquid carbon dioxide within the chamber to boil vigorously. Alternatively, the compressor may be connected between the cleaning chamber and the head space of the transfer tank 12. The cleaning chamber may also be connected directly to the head space of a storage tank having a sufficiently low pressure so that use of the compressor becomes unnecessary.

In some instances, items in the cleaning chamber may be sufficiently cleaned by the boiling liquid carbon dioxide so that agitation, and therefore usage of the cleaning nozzles (item 53 in FIG. 1F and item 61 in FIG. 1G), is unnecessary. Such an approach is particularly useful for cleaning electronic parts.

It is to be understood that the pressures and temperatures presented above are for example purposes only and that they are in no way intended to limit the scope of the invention. Furthermore, while the preferred embodiments of the invention have been shown and described, it will be apparent to those skilled in the art that changes and modifications may be made therein without departing from the spirit of the invention, the scope of which is defined by the appended claims.

What is claimed is:

1. A system for cleaning objects with liquid solvent comprising:

a) a cleaning chamber containing the objects;

b) first and second storage tanks selectively in communication with said cleaning chamber, each of said storage tanks containing a supply of said liquid solvent; and c) a compressor selectively in circuit between said storage tanks, said compressor initially pressurizing said first storage tank to deliver solvent to said cleaning chamber and subsequently pressurizing said second storage tank while depressurizing said first storage tank to deliver additional solvent to said cleaning chamber and to return excess solvent in said cleaning chamber to said first storage tank.

2. The system of claim 1 further comprising a transfer tank containing an additional supply of said solvent, said transfer tank selectively communicating with said cleaning chamber so that additional solvent may be added to the system.

3. The system of claim 1 wherein said liquid solvent is liquid carbon dioxide.

4. The system of claim 1 further comprising:

a) pressure sensors positioned within said first and second storage tanks;

b) a pressure sensor positioned with said cleaning chamber;

c) control means in communication with the compressor and the pressure sensors for controlling a pressure differential created by the compressor; and d) selector means in communication with the control means for selecting a desired pressure differential between a pressurized one of the storage tanks and the cleaning chamber.

5. The system of claim 1 further comprising a solvent additive dispenser containing a supply of liquid additive and having a head space selectively in communication with head spaces of said storage tanks, said solvent additive dispenser also having a liquid side selectively in circuit between said cleaning chamber and each of said storage tanks so that when one of said storage tanks is pressurized, the head space of said solvent additive dispenser is also pressurized so that additive is injected from the liquid side of the solvent additive dispenser into the solvent flowing from the cleaning chamber to the depressurized other storage tank.

6. The system of claim 5 further comprising a check valve in communication with the liquid side of said solvent additive dispenser so that additive may flow out of the solvent additive dispenser but solvent flowing from the cleaning chamber to the depressurized other storage tank may not flow into said solvent additive dispenser.

7. The system of claim 1 further comprising a heat sink in fluid communication with the outlet of said compressor, said storage tanks and said cleaning chamber whereby solvent gas traveling from the cleaning chamber to the storage tanks and from one storage tank to another is cooled by said heat sink and solvent gas circulated between an outlet and an inlet of the cleaning chamber is warmed by said heat sink.

8. The system of claim 1 wherein at least one of said storage tanks contains a recondensing coil, said recondensing coil being in communication with a refrigeration circuit so that pressure and temperature within the at least one storage tank may be controlled.

9. The system of claim 1 further comprising nozzles in communication with said cleaning chamber, said nozzles selectively communicating with said storage tanks to receive solvent from a pressurized one of said storage tanks to agitate objects in said chamber.

10. The system of claim 9 further comprising:

a) pressure sensors positioned within said first and second storage tanks;

b) a pressure sensor positioned with said cleaning chamber;

c) control means in communication with the compressor and the pressure sensors, said control means detecting pressure differentials across said nozzles by comparing pressures from each of said storage tanks when pressurized with a pressure of said cleaning chamber; and d) selector means in communication with the control means for selecting a desired pressure differential across said nozzles so that said compressor may be loaded and unloaded by said control means to obtain the desired pressure differential.

11. A method for circulating a liquid solvent between a cleaning chamber and a pair of storage tanks containing said solvent comprising the steps of:

a) pressurizing a first one of said tanks;

b) pressurizing said chamber to an intermediate pressure above atmospheric pressure but below that of said first tank to avoid thermal shock during filling of said chamber;

c) connecting said first tank to said chamber to substantially fill said chamber with solvent;

d) pressurizing a second one of said tanks while depressurizing said first tank; and e) connecting both tanks to said chamber, the pressure in said second tank driving additional solvent into said chamber, excess solvent flowing back to said first tank until said first tank is substantially full and said second tank is substantially empty.

12. The method of claim 11 further comprising the step of injecting an additive to enhance cleaning into the excess solvent flowing to the unpressurized first tank in step e).

13. The method of claim 11 further comprising the step of depressurizing said chamber when it is substantially full of solvent so that the solvent within said chamber boils so as to provide enhanced agitation within said chamber.

14. A system for cleaning objects with liquid solvent comprising:

a) a storage tank containing said solvent with a head space thereabove;

b) a cleaning chamber containing said objects;

c) a compressor selectively in circuit between said cleaning chamber and the head space of said storage tank, said compressor pressurizing said storage tank with solvent gas from said chamber so that liquid solvent flows to said cleaning chamber;

d) a plurality of nozzles disposed in the cleaning chamber; and e) means for transferring liquid solvent from said storage tank to said nozzles so that the objects within the chamber are agitated.

15. The system of claim 14 wherein said means for transferring includes a pump in circuit between the liquid of said storage tank and said nozzles, said pump disposed within a sump.

16. The system of claim 15 wherein said sump is rotatable between horizontal and vertical positions.

17. The system of claim 14 further comprising a transfer tank containing an additional supply of solvent, said transfer tank selectively in communication with said cleaning chamber so that said cleaning chamber may be pressurized with solvent gas from said transfer tank and replenished with liquid solvent from said transfer tank.

18. A method for cleaning objects in a cleaning chamber with liquid solvent supplied by storage tank comprising the steps of:

a) pressurizing the storage tank;

b) pressurizing the cleaning chamber to an intermediate pressure above atmospheric pressure but below that of the storage tank to avoid thermal shock during filling of the chamber;

c) connecting the storage tank to the chamber to fill the chamber with solvent; and d) depressurizing the chamber to a pressure below a saturation pressure of the liquid solvent so that the liquid solvent within the chamber boils and the objects in the chamber are cleaned.

19. The method of claim 18 wherein step d) includes the substeps of providing a compressor and connecting the compressor in circuit between the chamber and the storage tank so that solvent gas may be transferred from the cleaning chamber to the storage tank.

20. The method of claim 18 wherein step d) includes the substeps of providing a second storage tank at a pressure below the saturation pressure of the liquid solvent and connecting the chamber to the second storage tank so that solvent gas is transferred from the cleaning chamber to the second storage tank.

* * * * *